US008142973B2

(12) United States Patent
Hiraga et al.

(10) Patent No.: US 8,142,973 B2
(45) Date of Patent: Mar. 27, 2012

(54) LIQUID DEVELOPER AND IMAGE FORMING APPARATUS

(75) Inventors: Tomotake Hiraga, Shiojiri (JP); Takashi Teshima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 485 days.

(21) Appl. No.: 12/400,487

(22) Filed: Mar. 9, 2009

(65) Prior Publication Data

US 2009/0233214 A1 Sep. 17, 2009

(30) Foreign Application Priority Data

Mar. 11, 2008 (JP) ..... 2008-061550
Aug. 11, 2008 (JP) ..... 2008-207422

(51) Int. Cl.
*G03G 9/00* (2006.01)

(52) U.S. Cl. ..... 430/114; 430/112; 430/116

(58) Field of Classification Search ..... 430/112, 430/113, 114, 115, 116
See application file for complete search history.

(56) References Cited

U.S. PATENT DOCUMENTS 3,844,966 A * 10/1974 Nelson ..... 430/115
2008/0032225 A1* 2/2008 Teshima et al. ..... 430/114

FOREIGN PATENT DOCUMENTS

JP 2002-214849 7/2002

* cited by examiner

*Primary Examiner* — Mark F Huff
*Assistant Examiner* — Stewart Fraser
(74) *Attorney, Agent, or Firm* — DLA Piper LLP (US)

(57) ABSTRACT

A liquid developer includes an insulating liquid; toner particles constituted by a material containing a polyester resin; and an alkyl diamine and an amide compound having a hydroxy fatty acid skeleton as dispersants.

8 Claims, 3 Drawing Sheets

LIQUID DEVELOPER AND IMAGE FORMING APPARATUS

BACKGROUND

1. Technical Field

The present invention relates to a liquid developer and an image forming apparatus.

2. Related Art

As a developer to be used for developing an electrostatic latent image formed on a latent image carrying member, a liquid developer obtained by dispersing a toner constituted by a material containing a colorant such as a pigment and a binder resin in an electrically insulating carrier liquid (insulating liquid) is known.

As the binder resin to be used in toner particles constituting such a liquid developer, a polyester resin is widely used in general. The polyester resin has a high transparency and when it is used as a binder resin, it exhibits characteristics that a color developing property of the resulting image is good and a high fixing property can be obtained.

As the liquid developer, a negatively charged liquid developer and a positively charged liquid developer can be exemplified. In the case of using a negatively charged liquid developer, there were problems that ozone was generated in an image forming apparatus when an image was formed, resulting in causing an environmental problem or an adverse effect on peripheral units in the image forming apparatus, etc.

Therefore, recently, development of a method for forming an image using a positively charged liquid developer with which image formation can be performed by reducing a produced amount of a discharge product such as ozone has been advanced (see, for example, JP-A-2002-214849).

In the positively charged liquid developer described in JP-A-2002-214849, toner particles are positively charged by adding a charge control agent.

However, a polyester resin which has been used in toner particles generally has a high negative charging property, therefore, it was difficult to apply a polyester resin to positively charged toner particles (liquid developer). Further, it is conceivable that related toner particles using a polyester resin as a binder resin are positively charged by adding a charge control agent to the toner particles, however, it was difficult to obtain a sufficient charge amount.

Further, to a liquid developer, a dispersant is added for improving the dispersibility of toner particles. However, in general, when a dispersant was added, there was a problem that a charging characteristic of the liquid developer was decreased.

SUMMARY

An advantage of some aspects of the invention is to provide a liquid developer excellent in positive charging characteristic and dispersion stability of toner particles, and an image forming apparatus using such a liquid developer.

A liquid developer according to a first aspect of the invention includes:

an insulating liquid;

toner particles constituted by a material containing a polyester resin; and an alkyl diamine and an amide compound having a hydroxy fatty acid skeleton as dispersants.

In accordance with the aspect of the invention, a content of the alkyl diamine is preferably from 0.1 to 8 parts by weight based on 100 parts by weight of the toner particles.

In accordance with the aspect of the invention, the alkyl diamine is preferably a compound represented by the following general formula (I).

$$H_2N—R—NH—R' \quad (I)$$

In the formula, R represents an alkylene group having 2 to 6 carbon atoms, and R' represents an alkyl group having 8 to 24 carbon atoms.

In accordance with the aspect of the invention, a content of the amide compound having a hydroxy fatty acid skeleton is preferably from 0.1 to 7 parts by weight based on 100 parts by weight of the toner particles.

In accordance with the aspect of the invention, the amide compound having a hydroxy fatty acid skeleton is preferably a compound represented by the following general formula (II).

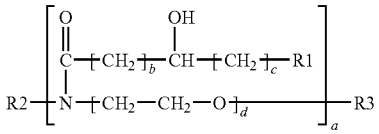

(II)

In the formula, R1, R2, and R3 each represent H, $CH_3$, OH, $OCH_3$, $OCH_2CH_3$, $OCH_2$, $CH_2CH_3$, or a fatty acid having 12 to 18 carbon atoms, a=1 to 5, b=1 to 21, c=1 to 21, d=1 to 5, and $(b+c) \leqq 26$.

In accordance with the aspect of the invention, the hydroxy fatty acid skeleton is preferably a 12-hydroxystearic acid skeleton.

In accordance with the aspect of the invention, the material constituting the toner particles preferably contains a rosin-modified resin other than the polyester resin.

In accordance with the aspect of the invention, the insulating liquid preferably contains a vegetable oil.

In accordance with the aspect of the invention, the insulating liquid preferably further contains a fatty acid monoester.

An image forming apparatus according to a second aspect of the invention includes:

plural developing units that form plural monochrome images corresponding to plural liquid developers of different colors using the plural liquid developers;

an intermediate transfer unit that transfers sequentially the plural monochrome images formed in the plural developing units and forms an intermediate transfer image by superimposing the transferred plural monochrome images;

a secondary transfer unit that transfers the intermediate transfer image to a recording medium and forms an unfixed color image on the recording medium; and a fixing unit that fixes the unfixed color image on the recording medium, wherein the liquid developers each contain:

an insulating liquid;

toner particles constituted by a material containing a polyester resin; and an alkyl diamine and an amide compound having a hydroxy fatty acid skeleton as dispersants.

In accordance with the aspect of the invention, preferably, the developing units each have a feed section that feeds the liquid developer for forming the monochrome image, a recovery section that recovers the excess liquid developer in the feed section, and a partition provided between the recovery section and the feed section, and the excess liquid developer in the feed section is recovered in the recovery section through the partition.

By satisfying the above-mentioned constitution, a liquid developer excellent in positive charging characteristic and dispersion stability of toner particles, and an image forming apparatus using such a liquid developer can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
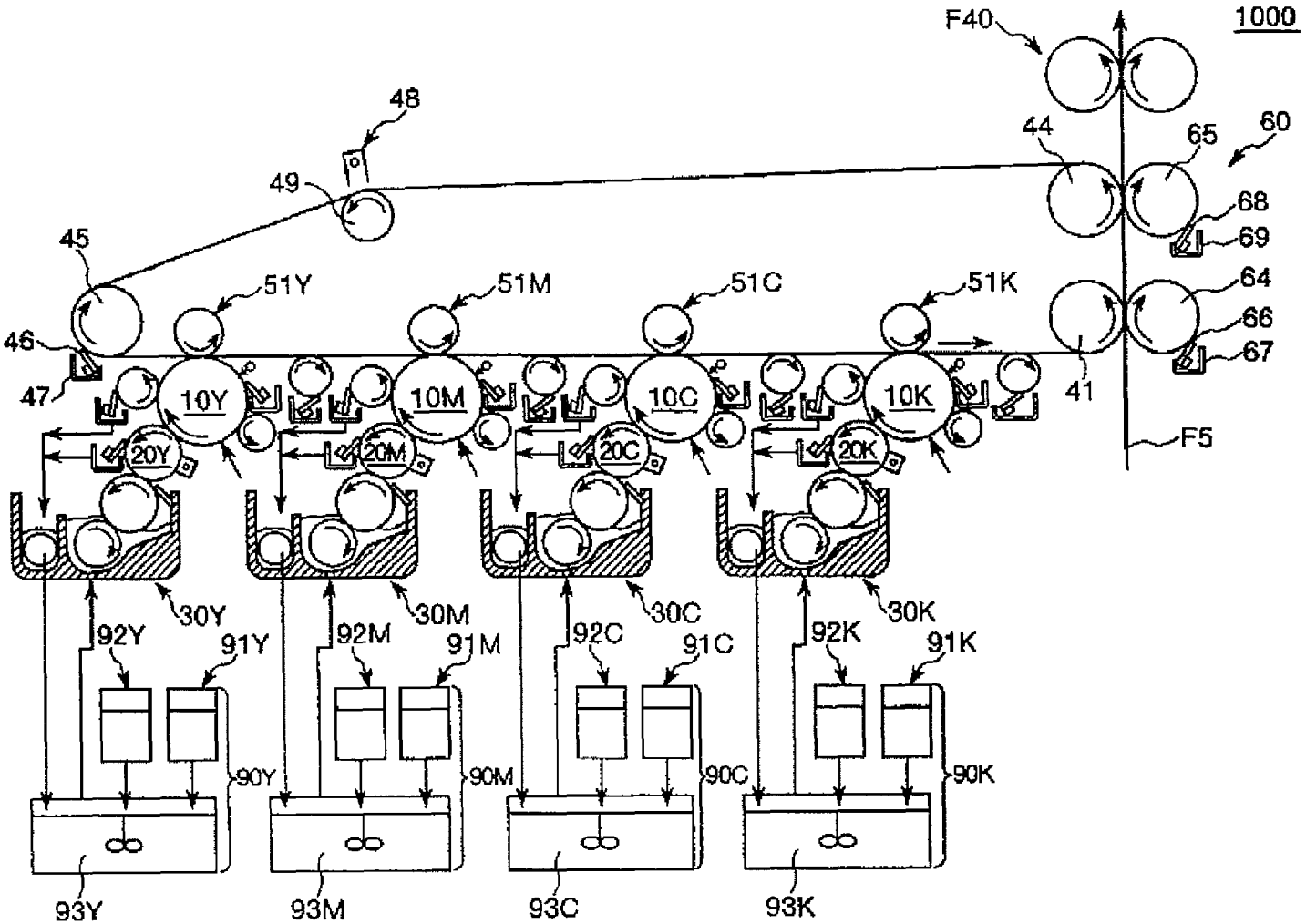
FIG. 1 is a schematic view showing an example of an image forming apparatus to which a liquid developer according to an embodiment of the invention is applied.

Hereinafter, preferred embodiments of the invention will be described in detail.

Liquid Developer

First, a liquid developer of an embodiment of the invention will be described. The liquid developer of the invention contains an insulating liquid having dispersed therein toner particles. Further, the liquid developer of the invention contains an alkyl diamine and an amide compound having a hydroxy fatty acid skeleton as dispersants.

Dispersant

First, the dispersant will be described.

The liquid developer of the invention contains an alkyl diamine and an amide compound having a hydroxy fatty acid skeleton as dispersants.

Incidentally, a polyester resin which has been used in toner particles generally has a high negative charging property, therefore, it was difficult to apply a polyester resin to positively charged toner particles (liquid developer) Further, it is conceivable that related toner particles containing a polyester resin as a binder resin are positively charged by adding a charge control agent to the toner particles, however, it was difficult to obtain a sufficient charge amount.

Further, to a liquid developer, a dispersant is added for improving the dispersibility of toner particles. However, in general, when a dispersant was added, there was a problem that a charging characteristic of the liquid developer was decreased.

On the other hand, by using an alkyl diamine and an amide compound having a hydroxy fatty acid skeleton as dispersants as in the invention, effects as mentioned below are obtained.

A polyester resin constituting toner particles generally has an acidic group (such as a carboxyl group) in its molecule. This acidic group and a nitrogen atom in each of the above-mentioned dispersants are bound through an ionic bond, and each of the dispersants is chemically adhered or adsorbed to the surface of the toner particles. Further, a nitrogen atom constituting each dispersant attracts a proton ($H^+$) released from an acidic group and the like of the polyester resin, and therefore, the toner particles can be positively charged. In this manner, the positive charging characteristic of the liquid developer can be made excellent. Further, because the liquid developer has an excellent charging characteristic, it also has excellent characteristics with respect to a developing efficiency, a transferring efficiency, and the like. Further, a moiety of the hydroxy fatty acid skeleton of the amide compound having a hydroxy fatty acid skeleton has a particularly high affinity for an insulating liquid (particularly a vegetable oil or a fatty acid monoester as mentioned below), therefore, the moiety is arranged such that it faces an insulating liquid side. Since the above-mentioned respective dispersants are adsorbed to the surface of the toner particles in such a state, the hydroxy fatty acid skeleton is interposed between adjacent toner particles thereby to effectively prevent aggregation and the like of the toner particles, and thus, the dispersion stability of the toner particles can be made excellent. Further, since the liquid developer has excellent dispersion stability as described above, when the liquid developer recovered in developing units and the like is reused in an image forming apparatus as mentioned below, the toner particles in the recovered liquid developer can be easily redispersed, and thus, the reuse thereof can be achieved easily.

As described above, by incorporating an alkyl diamine and an amide compound having a hydroxy fatty acid skeleton in the liquid developer of the invention as dispersants, both excellent positive charging characteristic and excellent dispersion stability can be achieved. In general, when two types of dispersants are used in combination, the property of one of the dispersants inhibits the property of the other dispersant and it is difficult to achieve the properties of both dispersants. However, in the invention, the properties of both the alkyl diamine and the amide compound having a hydroxy fatty acid skeleton as mentioned in detail below can be achieved, and also by a synergistic effect, the respective properties can be more markedly exhibited.

On the other hand, when only one of the alkyl diamine and the amide compound having a hydroxy fatty acid skeleton is used, it is not possible to achieve both excellent positive charging characteristic and excellent dispersion stability as described above. That is, when only the alkyl diamine is used, sufficient dispersion stability cannot be exhibited. Further, when only the amide compound having a hydroxy fatty acid skeleton is used, it becomes difficult to positively charge the toner particles.

Hereinafter, the respective dispersants will be described in detail.

Alkyl Diamine

The alkyl diamine is a component which mainly makes a contribution to the positive charging characteristic of the liquid developer.

As the alkyl diamine, a compound having any of various structures can be used, however, particularly, a compound represented by the following general formula (I) is preferably used.

$$H_2N—R—NH—R' \quad (I)$$

In the formula, R represents an alkylene group having 2 to 6 carbon atoms, and R' represents an alkyl group having 8 to 24 carbon atoms.

By using the alkyl diamine having such a structure, a nitrogen atom in the secondary amine moiety (—NHR') can efficiently attract a proton ($H^+$) released from an acidic group and the like of the polyester resin, and therefore, the toner particles can be positively charged more effectively. As a result, the positive charging characteristic of the liquid developer can be made particularly excellent.

Further, since the alkyl diamine having the above-mentioned structure has a primary amine moiety ($NH_2$—), it binds to an acidic group on the surface of the toner particles through a relatively strong ionic bond and is more rigidly adhered (adsorbed) to the surface of the toner particles. As a result, the alkyl diamine can be allowed to more surely exist on the surface of the toner particles, and therefore the liquid developer can exhibit a more stable positive charging characteristic. Further, since the secondary amine moiety (—NHR') of the alkyl diamine having the above-mentioned structure has a high affinity for an insulating liquid, the secondary amine moiety is disposed to face an insulating liquid side while maintaining a state of being adhered (adsorbed) to the surface of the toner particles. As a result, in combination with the below-mentioned effect of the amide compound having a hydroxy fatty acid skeleton on improvement of dispersibility, aggregation and the like of the toner particles can be more effectively prevented, and thus, the dispersibility of the toner particles can be made particularly excellent.

As described above, in the above-mentioned structural formula (I), R is preferably an alkylene group having 2 to 6 carbon atoms, more preferably an alkylene group having 2 to 4 carbon atoms. According to this, the dispersion stability of the toner particles can be further improved.

Further, as described above, in the above-mentioned structural formula (I), R' is preferably an alkyl group having 8 to 24 carbon atoms, more preferably an alkyl group having 8 to 20 carbon atoms. According to this, the dispersion stability of the toner particles can be further improved.

The alkyl diamine may be a mixture containing plural types of compounds represented by the above-mentioned structural formula (I) having different numbers of carbons in R or R'.

Examples of the alkyl diamine having the above-mentioned structure include Duomin CD, Duomin T, Duomin HT ("Duomin" is the trade name of Lion Akzo Co., Ltd.), Asphazol #10 and Asphazol #20 ("Asphazol" is the trade name of NOF Corporation), and these can be used alone or in combination of two or more of them.

An amine value of the alkyl diamine is preferably from 50 to 500 mg KOH/g, more preferably from 400 to 450 mg KOH/g. According to this, the toner particles can be more surely positively charged and also the dispersion stability of the toner particles can be further improved.

A content of the alkyl diamine in the liquid developer is preferably from 0.1 to 8 parts by weight, more preferably from 0.3 to 5 parts by weight, further more preferably from 0.6 to 1 part by weight based on 100 parts by weight of the toner particles. When the content of the alkyl diamine falls within the above-mentioned range, the positive charging characteristic can be made particularly excellent.

Amide Compound Having Hydroxy Fatty Acid Skeleton

The amide compound having a hydroxy fatty acid skeleton is a component which mainly makes a contribution to the dispersion stability of the toner particles.

As the amide compound having a hydroxy fatty acid skeleton, a compound having any of various structures can be used, however, particularly, a compound represented by the following general formula (II) is preferably used.

(II)

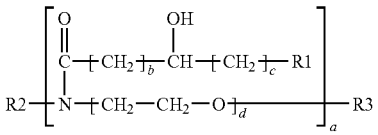

In the formula, R1, R2, and R3 each represent H, $CH_3$, OH, $OCH_3$, $OCH_2CH_3$, $OCH_2$, $CH_2CH_3$, or a fatty acid having 12 to 18 carbon atoms, a=1 to 5, b=1 to 21, c=1 to 21, d=1 to 5, and (b+c)≦26.

By using the amide compound having such a structure, a main chain containing a nitrogen atom is more surely adhered (adsorbed) to the surface of the toner particles, and a side chain of a hydroxy fatty acid skeleton is more effectively arranged on an insulating liquid side. As a result, the dispersion stability of the toner particles can be made particularly excellent.

Further, the nitrogen atom in the main chain not only makes a contribution to adhesion (adsorption) to the surface of the toner particles, but also can attract a proton ($H^+$) released in the insulating liquid to some extent, therefore, by a synergistic effect with the alkyl diamine as described above, the positive charging characteristic can be made more excellent.

Further, in the above-mentioned structure, the hydroxy fatty acid skeleton is preferably a 12-hydroxystearic acid skeleton. According to this, a side chain moiety can be more surely arranged on an insulating liquid side. As a result, the 12-hydroxystearic acid skeleton is surely interposed between adjacent toner particles thereby to effectively prevent aggregation and the like of the toner particles, and thus, the dispersion stability of the toner particles can be made particularly excellent.

Examples of the amide compound having the structure as described above include Solsperse 11200 and Solsperse 17000 ("Solsperse" is the trade name of The Lubrizol Corporation), and these can be used alone or in combination of two or more of them.

A content of the amide compound in the liquid developer is preferably from 0.1 to 7 parts by weight, more preferably from 0.5 to 3 parts by weight, further more preferably from 0.6 to 1.5 parts by weight based on 100 parts by weight of the toner particles. When the content of the amide compound falls within the above-mentioned range, the dispersibility of the toner particles can be more effectively improved.

Toner Particles

Subsequently, the toner particles will be described.

Constituent Material of Toner Particles

The toner particles include at least a resin material containing a polyester resin.

1. Resin material

In the invention, the resin material contains a polyester resin. The polyester resin has a high transparency and when it is used as a binder resin, it exhibits characteristics that a color developing property of the resulting image is good and a high fixing property can be obtained. However, since the polyester resin is a component showing a negative charging characteristic or a low charging characteristic (in the case of having a low acid value) as described above, toner particles constituted by such a polyester resin generally has a negative charging property. In the invention, by adhering (adsorbing) each of the dispersants as described above to the surface of the toner particles, a liquid developer excellent in positive charging characteristic and dispersion stability while effectively exhibiting the effect of using a polyester resin as described above can be obtained. A content of the polyester resin in the resin material is preferably 50 wt % or more, more preferably 80 wt % or more.

Further, as the polyester resin, it is preferred that a low-molecular weight polyester resin having a weight average molecular weight Mw of from 3000 to 12000 and a high-molecular weight polyester resin having a weight average molecular weight Mw of from 20000 to 400000 are used in combination. According to this, the toner particles can be surely prevented from aggregating with one another during storage and also the toner particles can be fixed on a recording medium at a relatively low temperature during fixation.

The low-molecular weight polyester resin preferably has ethylene glycol (EG) and/or neopentyl glycol (NPG) as a constituent monomer component. Further, when the contents of EG and NPG in all constituent monomers to be used in the synthesis of the low-molecular weight polyester resin are denoted by W(EG) [wt %] and W(NPG) [wt %], respectively, a weight ratio of EG to NPG (W(EG)/W(NPG)) is preferably from 0 to 1.1, more preferably from 0.8 to 1.0. According to this, the storage stability of the toner particles can be made sufficiently excellent. Further, the toner particles can be fixed on a recording medium more stably at a low temperature. Also, such a liquid developer can be more preferably applied to high-speed image formation.

Further, a glass transition point Tg of the low-molecular weight polyester resin is preferably from 30 to 55° C., more preferably from 35 to 50° C. By using the low-molecular weight polyester resin that satisfies the above-mentioned conditions as a constituent material of the toner particles, aggregation and fusion of the toner particles can be more surely prevented during storage and the storage stability of the liquid developer becomes more excellent. Further, the toner particles can be more preferably fixed on a recording medium at a low temperature.

Further, a softening point T1/2 of the low-molecular weight polyester resin is preferably from 60 to 120° C., more preferably from 80 to 110° C. By using the polyester resin that satisfies the above-mentioned conditions as a constituent material of the toner particles, aggregation and fusion of the toner particles can be more surely prevented during storage and the storage stability of the liquid developer becomes more excellent. In addition, during fixation, the toner particles can be fused with a smaller amount of heat. According to this, the toner particles can be fixed more stably at a low temperature. Also, such a liquid developer can be more preferably applied to high-speed image formation.

In this specification, the term "glass transition point Tg" refers to a temperature of an intersection of the extension of the baseline of equal to or lower than the glass transition point and the tangential line showing the maximum inclination between the kick-off of the peak and the top of the peak which is determined using a differential scanning calorimeter DSC-220C (manufactured by Seiko Instruments, Inc.) under the following measurement conditions: sample amount: 10 mg; temperature increasing rate: 10° C./min; and measurement temperature range: 10 to 150° C.

Further, the term "softening point" refers to a softening initiation temperature defined by using a koka-type flow tester (manufactured by Shimadzu Corporation) under the following measurement conditions: temperature increasing rate: 5° C./min; and die diameter: 1.0 mm.

Further, when the polyester resin is contained in the toner particles, a content of the low-molecular weight polyester resin in the polyester resin is preferably from 50 to 90 wt %, more preferably from 60 to 80 wt %. According to this, the liquid developer is particularly excellent in storage stability and low-temperature fixing property.

The high-molecular weight polyester resin as described above preferably has ethylene glycol (EG) and/or neopentyl glycol (NPG) as a constituent monomer component. Further, when the contents of EG and NPG in all constituent monomers to be used in the synthesis of such a polyester resin are denoted by W(EG) [wt %] and W(NPG) [wt %], respectively, a weight ratio of EG to NPG (W(EG)/W(NPG)) is preferably from 1.2 to 3.0, more preferably from 1.5 to 2.0. According to this, the liquid developer is particularly excellent in storage stability. Further, during fixation, the toner particles can be more preferably fixed on a recording medium at a low temperature. In addition, the fixed toner particles are more excellent in adhesiveness to a recording medium and weather resistance, and thus, a resulting toner image has particularly excellent durability.

Further, a glass transition point Tg of the high-molecular weight polyester resin is preferably from 45 to 70° C., more preferably from 50 to 65° C. By using the high-molecular weight polyester resin that satisfies the above-mentioned conditions as a constituent material of the toner particles, aggregation and fusion of the toner particles can be more surely prevented during storage and the storage stability of the liquid developer becomes more excellent. In particular, even when the liquid developer is stored at a high temperature, the toner particles are more surely prevented from aggregating with one another, and the liquid developer is particularly excellent in high-temperature storage stability. Further, the toner particles can be more preferably fixed on a recording medium at a low temperature.

Further, a softening point T1/2 of the high-molecular weight polyester resin is preferably from 60 to 220° C., more preferably from 80 to 190° C. By using the polyester resin that satisfies the above-mentioned conditions as a constituent material of the toner particles, aggregation and fusion of the toner particles can be more surely prevented during storage and the storage stability of the liquid developer becomes more excellent. In addition, during fixation, the toner particles can be more rigidly fixed on a recording medium at a low temperature.

A glass transition point Tg of the polyester resin containing the low-molecular weight polyester resin and the high-molecular weight polyester resin as described above is preferably from 35 to 60° C., more preferably from 40 to 50° C. By using the polyester resin that satisfies the above-mentioned conditions as a constituent material of the toner particles, aggregation and fusion of the toner particles can be more surely prevented during storage and the storage stability of the liquid developer becomes more excellent. Further, the toner particles can be more preferably fixed on a recording medium at a low temperature.

Further, when the polyester resin is contained in the toner particles, a content of the high-molecular weight polyester resin in the polyester resin is preferably from 10 to 50 wt %, more preferably from 20 to 40 wt %. According to this, the liquid developer is particularly excellent in storage stability and low-temperature fixing property.

An acid value of the polyester resin to be used in the invention is preferably from 5 to 15 mg KOH/g, more preferably from 5 to 10 mg KOH/g. According to this, the dispersants as described above can be more effectively retained on the surface of the toner mother particles. When the acid value of the polyester resin is lower than the above lower limit, the above-mentioned respective dispersants cannot be sufficiently adhered to the surface of the toner particles in some cases. On the other hand, when the acid value of the polyester resin exceeds the above upper limit, the polyester resin has a strong negative charging characteristic, and a desired positive charging characteristic cannot be sufficiently obtained in some cases.

Further, a glass transition point Tg of the total resin material containing the polyester resins as described above is preferably from 15 to 70° C., more preferably from 20 to 55° C. According to this, in the liquid developer containing the produced toner particles, aggregation and fusion of the toner particles can be more surely prevented during storage, and thus, the storage stability of the liquid developer becomes more excellent. Further, the toner particles can be more preferably fixed on a recording medium at a low temperature.

Further, a softening point T1/2 of the resin material containing the polyester resins as described above is not particularly limited, however, it is preferably from 50 to 130° C., more preferably from 50 to 120° C., further more preferably from 60 to 115° C.

In addition, as the resin material constituting the toner particles, a known resin other than the above-mentioned polyester resins may be contained.

The resin material other than the polyester resins is not particularly limited, however, it is preferred to use a rosin-modified resin.

By using the rosin-modified resin, effects as mentioned below are obtained.

The rosin-modified resin has a particularly high affinity for the respective dispersants as described above, therefore, the above-mentioned respective dispersants can be rigidly adhered (adsorbed) to the surface of the toner particles. Further, such a rosin-modified resin is a component plasticized by the insulating liquid as mentioned below. Accordingly, in the case of the toner particles containing the rosin-modified resin as a constituent component, the respective dispersants as described above can be more rigidly adhered (adsorbed) to their surface. As a result, the dispersion stability of the toner particles can be made particularly excellent and also the positive charging characteristic of the liquid developer can be made particularly excellent.

Further, since the rosin-modified resin has a low compatibility with the above-mentioned polyester resin, by using the polyester resin and the rosin-modified resin in combination, the rosin-modified resin can be localized on the surface of the toner particles. By localizing the rosin-modified resin in this manner, each of the dispersants can be allowed to surely exist on the surface of the toner particles, and the dispersion stability and the positive charging characteristic can be made particularly excellent.

Examples of the rosin-modified resin include rosin-modified phenol resins, rosin-modified maleic resins, rosin-modified polyester resins, fumaric acid-modified rosin resins, and ester gums. These can be used alone or in combination of two or more of them.

A softening point of the rosin-modified resin as described above is preferably from 80 to 190° C., more preferably from 80 to 160° C., further more preferably from 80 to 130° C. According to this, the long-term dispersion stability and the charging characteristic of the toner particles can be made excellent, and also the fixing property and the heat resistant storage stability of the toner particles can be achieved at a high level.

Further, a weight average molecular weight of the rosin-modified resin is preferably from 500 to 100000, more preferably from 1000 to 80000, further more preferably from 1000 to 50000. According to this, the long-term dispersion stability and the charging characteristic of the toner particles can be made excellent, and also the fixing property and the heat resistant storage stability of the toner particles can be achieved at a high level.

Further, an acid value of the rosin-modified resin is preferably 40 mg KOH/g or less, more preferably 30 mg KOH/g or less, further more preferably 25 mg KOH/g or less.

Further, a content of the rosin-modified resin in the resin material constituting the toner particles is preferably from 1 to 50 wt %, more preferably from 5 to 40 wt %. According to this, the rosin-modified resin can be allowed to more surely exist on the surface of the toner particles, and the dispersion stability and the positive charging characteristic of the toner particles can be more effectively improved.

2. Colorant

Further, the toner may contain a colorant. The colorant is not particularly limited, and for example, a known pigment, dye, or the like can be used.

3. Other Components

Further, the toner may also contain components other than the above-mentioned components. Examples of such components include known waxes and magnetic powder.

Further, as a constituent material (component) of the toner particles, for example, zinc stearate, zinc oxide, cerium oxide, silica, titanium oxide, iron oxide, a fatty acid, a fatty acid metal salt, or the like may be used other than the above-mentioned components.

Shape of Toner Particles

An average particle diameter of the toner particles constituted by the material as described above is preferably from 0.5 to 4.0 μm, more preferably from 1 to 4.0 μm, further more preferably from 1 to 3.5 μm. When the average particle diameter of the toner particles falls within the above-mentioned range, a variation in properties among the toner particles can be made small, whereby a resolution of a toner image formed with the liquid developer can be made sufficiently high while making the reliability of the obtaining liquid developer as a whole high. Further, the dispersibility of the toner particles in the insulating liquid can be made favorable and the storage stability of the liquid developer can be made high. The term "average particle diameter" as used herein refers to an average particle diameter by volume unless otherwise stated.

A content of the toner particles in the liquid developer is preferably from 10 to 60 wt %, more preferably from 20 to 50 wt %.

Insulating Liquid

Subsequently, the insulating liquid will be described.

The insulating liquid may be any as long as it is a liquid having a sufficiently high insulating property, however, specifically, the insulating liquid has an electric resistance at room temperature (20° C.) of preferably $10^{11}$ Ωcm or more, more preferably $10^{12}$ Ωcm or more, further more preferably $10^{13}$ Ωcm or more.

Further, a relative dielectric constant of the insulating liquid is preferably 3.5 or less.

Examples of the insulating liquid that satisfies the above-mentioned conditions include mineral oils (hydrocarbon liquids) such as Isopar E, Isopar G, Isopar H, and Isopar L ("Isopar" is the trade name of Exxon Chemical Company) Shellsol 70 and Shellsol 71 ("Shellsol" is the trade name of Shell Oil Company), Amsco OMS and Amsco 460 solvents ("Amsco" is the trade name of Spirits Co.), and low-viscosity/high-viscosity liquid paraffins (Wako Pure Chemical Industries, Ltd.), vegetable oils such as fatty acid glycerides and medium-chain fatty acid esters, fatty acid monoesters which are esters of a fatty acid and a monohydric alcohol, octane, isooctane, decane, isodecane, decalin, nonane, dodecane, isododecane, cyclohexane, cyclooctane, cyclodecane, benzene, toluene, xylene, and mesitylene. These can be used alone or in combination of two or more of them. Among these, especially, the vegetable oil can further improve the dispersion stability of the toner particles because it contains a fatty acid triglyceride as a main component and therefore has a particularly high affinity for (compatibility with) the dispersants as described above (particularly the hydroxy fatty acid skeleton moiety of the amide compound). In addition, the vegetable oil has a high affinity also for the polyester resin constituting the toner particles, and therefore particularly excellent dispersion stability can be exhibited. Further, from a fatty acid released from the vegetable oil, a proton can be donated to the toner particles, therefore, the vegetable oil is also advantageous for the positive charging characteristic. In addition, it can prevent the charging characteristic from varying. Further, the vegetable oil is an environmentally benign component. Accordingly, a load on the environment of the insulating liquid caused by leakage of the insulating liquid outside the image forming apparatus and disposal of the used liquid developer can be reduced. As a result, an environmentally benign liquid developer can be provided.

Further, among the above-mentioned insulating liquids, it is preferred to use one containing a fatty acid monoester as the insulating liquid. The fatty acid monoester has a similar structure to the hydroxy fatty acid skeleton moiety of the amide compound, and therefore, it can further improve the dispersion stability of the toner particles in the same manner as the vegetable oil. In particular, by using the fatty acid monoester in combination with the vegetable oil, the above-mentioned effect can be more effectively exhibited. Further, from a fatty acid released from the fatty acid monoester, a proton can be donated to the toner particles, therefore, the insulating liquid containing the fatty acid monoester is also advantageous for the positive charging characteristic.

Further, the fatty acid monoester is a component having an effect of plasticizing the toner particles (polyester resin, rosin-modified resin) (plasticizing effect). By plasticizing the toner particles with the fatty acid monoester, the respective dispersant components as described above can be rigidly adhered (adsorbed) to the surface of the toner particles, and the positive charging characteristic of the toner particles can be further improved, and also the dispersion stability thereof can be further improved. In addition, the plasticized toner particles can be easily adhered to a recording medium, and the fixing property of the toner particles can be further improved.

Examples of such a fatty acid monoester include alkyl (such as methyl, ethyl, propyl, or butyl) monoesters of an unsaturated fatty acid typified by oleic acid, palmitoleic acid, linoleic acid, α-linolenic acid, γ-linolenic acid, arachidonic acid, docosahexaenoic acid (DHA), eicosapentaenoic acid (EPA), etc., and alkyl (such as methyl, ethyl, propyl, or butyl) monoesters of a saturated fatty acid typified by butyric acid, caproic acid, caprylic acid, capric acid, lauric acid, myristic acid, palmitic acid, stearic acid, arachidinic acid, behenic acid, lignoceric acid, etc. These can be used alone or in combination of two or more of them.

When the insulating liquid contains the fatty acid monoester, a content of the fatty acid monoester in the insulating liquid is preferably from 1 to 50 wt %, more preferably from 5 to 45 wt %. According to this, the toner particles can be preferably plasticized, and each of the above-mentioned dispersants can be more surely adhered (adsorbed) to the surface of the tonerparticles. As a result, the dispersion stability of the toner particles can be further improved, and the positive charging characteristic can be made particularly excellent.

A viscosity of the insulating liquid is not particularly limited, however, it is preferably from 5 to 1000 mPa·s, more preferably from 50 to 800 mPa·s, further more preferably from 50 to 500 mPa·s. In the case where the viscosity of the insulating liquid falls within the above-mentioned range, when the liquid developer is drawn out of a developer vessel by a coating roller, an adequate amount of the insulating liquid is adhered to the toner particles, and the developing property and transferring property of a toner image can be made particularly excellent. In this connection, the term "viscosity" as used herein refers to a value obtained by measurement at 25° C. unless otherwise stated.

Process for Producing Liquid Developer

Subsequently, a preferred embodiment of the process for producing the liquid developer according to the invention will be described.

The process for producing the liquid developer according to this embodiment includes a dispersion liquid preparation step of preparing a dispersion liquid in which a resin material and a colorant are dispersed in an aqueous dispersion medium; a coalescence step of obtaining coalescent particles by coalescing plural dispersoids; a solvent removal step of removing an organic solvent contained in the coalescent particles to obtain toner particles containing the resin material and the colorant; and a dispersion step of dispersing the toner particles and the respective dispersants as described above in an insulating liquid.

Hereinafter, the respective steps constituting the process for producing the liquid developer will be described in detail.

Dispersion Liquid Preparation Step (Aqueous Dispersion Liquid Preparation Step)

First, a dispersion liquid (aqueous dispersion liquid) is prepared.

The aqueous dispersion liquid may be prepared by any method, and for example, it can be prepared as follows. A constituent material (toner material) of toner particles such as a resin material and a colorant is dissolved or dispersed in an organic solvent to obtain a resin liquid (resin liquid preparation treatment) and an aqueous dispersion medium constituted by an aqueous liquid is added to the resin liquid to form dispersoids (dispersoids in a liquid state) containing the toner material in the aqueous liquid, whereby a dispersion liquid (aqueous dispersion liquid) in which the dispersoids are dispersed is obtained (dispersoid formation treatment).

Resin Liquid Preparation Treatment

First, a resin liquid in which a resin material and a hydrolysis inhibitor are dissolved or dispersed in an organic solvent is prepared.

The prepared resin liquid contains a constituent material of the toner particles as described above and an organic solvent as described below.

The organic solvent may be any as long as it can dissolve at least a portion of the resin material, however, it is preferred to use an organic solvent having a boiling point lower than that of an aqueous liquid mentioned below. According to this, the organic solvent can be easily removed.

Further, the organic solvent preferably has a low compatibility with an aqueous dispersion medium (aqueous liquid) mentioned below (for example, an organic solvent having a solubility in 100 g of the aqueous dispersion medium at 25° C. of 30 g or less). According to this, the toner material can be finely dispersed in an aqueous emulsion liquid in a stable state.

Further, a composition of the organic solvent can be appropriately selected depending on, for example, the composition of the resin material as described above and the colorant, the composition of the aqueous dispersion medium, or the like.

Such an organic solvent is not particularly limited, however, examples thereof include ketone solvents such as MEK and aromatic hydrocarbon solvents such as toluene.

The resin liquid can be obtained by mixing, for example, a resin material, a colorant, an organic solvent, and the like using a stirrer or the like. Examples of the stirrer which can be used in the preparation of the resin liquid include high-speed stirrers such as DESPA (manufactured by Asada Iron Works Co., Ltd.) and T.K. Robomix/T.K. Homo Disper Model 2.5 (manufactured by Primix Corporation).

Further, a temperature of the material during stirring is preferably from 20 to 60° C., more preferably from 30 to 50° C.

A solid content in the resin liquid is not particularly limited, however, it is preferably from 40 to 75 wt %, more preferably from 50 to 73 wt %, furthermore preferably from 50 to 70 wt %. When the solid content falls within the above-mentioned range, dispersoids constituting a dispersion liquid (emulsified suspension liquid) mentioned below can be made to have a higher sphericity (a shape close to a sphere), and the shape of the finally obtained toner particles can be more surely made favorable.

Further, in the preparation of the resin liquid, all constituent components of the resin liquid to be prepared may be mixed simultaneously, or part of the constituent components of the resin liquid to be prepared are mixed to obtain a mixture (master mix) and thereafter, the mixture (master mix) may be mixed with the other components.

Dispersoid Formation Treatment

Subsequently, an aqueous dispersion liquid (dispersion liquid) is prepared.

By adding an aqueous dispersion medium constituted by an aqueous liquid to the resin liquid, dispersoids (dispersoids in a liquid state) containing the toner material are formed in an aqueous liquid, whereby a dispersion liquid (aqueous dispersion liquid) in which the dispersoids are dispersed is obtained.

The aqueous dispersion medium is constituted by an aqueous liquid.

As the aqueous liquid, a liquid which is mainly constituted by water can be used.

In the aqueous liquid, for example, a solvent excellent in compatibility with water (for example, a solvent having a solubility in 100 parts by weight of water at 25° C. of 50 parts by weight or more) may be contained.

Further, to the aqueous dispersion medium, an emulsifying dispersant may be added as needed. By adding an emulsifying dispersant thereto, the aqueous emulsion liquid can be more easily prepared.

The emulsifying dispersant is not particularly limited, and for example, a known emulsifying dispersant can be used.

Further, when the aqueous dispersion liquid is prepared, for example, a neutralizing agent may be used. By using the neutralizing agent, for example, a functional group (such as a carboxyl group) in the resin material can be neutralized, and the uniformity of the shape and size of the dispersoids in the aqueous dispersion liquid to be prepared, and the dispersibility of the dispersoids can be made particularly excellent. Consequently, the resulting toner particles have a particularly narrow particle size distribution.

The neutralizing agent may be added to, for example the resin liquid, or to the aqueous liquid.

Further, in the preparation of the aqueous dispersion liquid, the neutralizing agent may be added in divided portions.

As the neutralizing agent, a basic compound can be used. Specific examples thereof include inorganic bases such as sodium hydroxide, potassium hydroxide, and ammonia; and organic bases such as diethylamine, triethylamine, and isopropylamine, and these can be used alone or in combination of two or more of them. Further, the neutralizing agent may be an aqueous solution containing a compound as described above.

An addition amount of the basic compound is preferably an amount corresponding to 1 to 3 times (1 to 3 equivalents), more preferably an amount corresponding to 1 to 2 times (1 to 2 equivalents) the amount necessary for neutralizing all the carboxyl groups in the resin material. According to this, the formation of irregularly shaped dispersoids can be effectively prevented, and further, a particle size distribution of particles obtained in the coalescence step mentioned in detail below can be made sharper.

The addition of the aqueous liquid to the resin liquid may be performed by any method, however, it is preferred that the aqueous liquid containing water is added to the resin liquid while stirring the resin liquid. That is, it is preferred that the aqueous liquid is gradually added (dropwise) to the resin liquid while applying a shearing force to the resin liquid using a stirrer or the like to cause phase conversion from a W/O-type emulsion liquid into an O/W-type emulsion liquid, and the aqueous dispersion liquid in which dispersoids derived from the resin liquid are dispersed in the aqueous liquid is finally obtained.

Examples of the stirrer which can be used in the preparation of the aqueous dispersion liquid include high-speed stirrers and high-speed dispersers such as DESPA (manufactured by Asada Iron Works Co., Ltd.), T.K. Robomix/T.K. Homo Disper Model 2.5 (manufactured by Primix Corporation), Slasher (manufactured by Mitsui Mining Co., Ltd.), and Cavitron (manufactured by Eurotec, Ltd.).

Further, during the addition of the aqueous liquid to the resin liquid, stirring is preferably performed such that a peripheral velocity of the stirring blade falls within a range from 10 to 20 m/sec, more preferably from 12 to 18 m/sec. When the peripheral velocity of the stirring blade falls within the above-mentioned range, the aqueous dispersion liquid can be efficiently obtained and also a variation in shape and size of the dispersoids in the aqueous dispersion liquid can be made particularly small, and the uniform dispersibility of the dispersoids can be made particularly excellent while preventing the generation of too small dispersoids and coarse particles.

A solid content in the aqueous dispersion liquid is not particularly limited, however, it is preferably from 5 to 55 wt %, more preferably from 10 to 50 wt %. According to this, the productivity of the toner particles can be made particularly excellent while more surely preventing unwanted aggregation of the dispersoids in the aqueous dispersion liquid.

Further, a temperature of the material in this treatment is preferably from 20 to 60° C., more preferably from 20 to 50° C.

Coalescence Step

Subsequently, coalescent particles are obtained by coalescing the plural dispersoids (coalescence step). The coalescence of the dispersoids usually proceeds by colliding the dispersoids containing an organic solvent and combining them with one another.

The coalescence of the plural dispersoids is performed by adding an electrolyte to the dispersion liquid while stirring the dispersion liquid. According to this, coalescent particles can be easily and surely obtained. Further, by controlling an addition amount of the electrolyte, the particle diameter and particle size distribution of the coalescent particles can be easily and surely controlled.

The electrolyte is not particularly limited, and known organic and inorganic water-soluble salts and the like can be used alone or in combination of two or more of them.

Further, the electrolyte is preferably a monovalent cationic salt. According to this, the particle size distribution of the resulting coalescent particles can be made narrow. In addition, by using a monovalent cationic salt, the generation of coarse particles can be surely prevented in this step.

Further, among the monovalent cationic salts, the electrolyte is preferably a sulfate (such as sodium sulfate or ammonium sulfate) or a carbonate, and particularly preferably a sulfate. According to this, the particle diameter of the coalescent particles can be particularly easily controlled.

An amount of the electrolyte to be added in this step is preferably from 0.5 to 3 parts by weight, more preferably from 1 to 2 parts by weight based on 100 parts by weight of the solid content in the dispersion liquid to which the electrolyte is added. According to this, the particle diameter of the coalescent particles can be particularly easily and surely controlled, and also the generation of coarse particles can be surely prevented.

Further, the electrolyte is preferably added in a state of an aqueous solution. According to this, the electrolyte can be promptly diffused in the entire dispersion liquid and also an addition amount of the electrolyte can be easily and surely controlled. As a result, the coalescent particles having a desired particle diameter and a particularly narrow particle size distribution can be obtained.

When the electrolyte is added in a state of an aqueous solution, a concentration of the electrolyte in the aqueous solution is preferably from 2 to 10 wt %, more preferably from 2.5 to 6 wt %. According to this, the electrolyte can be particularly promptly diffused in the entire dispersion liquid and also an addition amount of the electrolyte can be easily and surely controlled. Further, by adding such an aqueous solution, a content of water in the dispersion liquid after completion of addition of the electrolyte is made preferable. Accordingly, a growing rate of the coalescent particles after addition of the electrolyte can be made adequately slow to such an extent that the productivity is not decreased. As a result, the particle diameter thereof can be more surely controlled. In addition, unwanted coalescence of the coalescent particles can be surely prevented.

Further, when the electrolyte is added in a state of an aqueous solution, an addition rate of the aqueous electrolyte solution is preferably from 0.5 to 10 parts by weight/min, more preferably from 1.5 to 5 parts by weight/min based on 100 parts by weight of the solid content in the dispersion liquid to which the aqueous electrolyte solution is added. According to this, the occurrence of uneven electrolyte concentration in the dispersion liquid can be prevented, and the generation of coarse particles can be surely prevented. In addition, the particle size distribution of the coalescent particles becomes particularly narrow. Further, by adding the electrolyte at such a rate, the coalescence rate can be particularly easily controlled, and controlling of the average particle diameter of the coalescent particles becomes particularly easy, and also the productivity of toner can be made particularly excellent.

The electrolyte may be added in divided portions. According to this, the coalescent particles having a desired size can be easily and surely obtained, and also the degree of circularity of the resulting coalescent particles can be surely made sufficiently high.

Further, this step is performed while stirring the dispersion liquid. According to this, the coalescent particles having a particularly small variation in shape and size among the particles can be obtained.

For stirring the dispersion liquid, a stirring blade such as an anchor blade, a turbine blade, a pfaudler blade, a fullzone blade, a maxblend blade, or a crescentic blade can be used, and in particular, a maxblend blade or a fullzone blade is preferred. According to this, the added electrolyte can be promptly and uniformly dispersed or dissolved, and the occurrence of uneven electrolyte concentration can be surely prevented. Further, the dispersoids can be efficiently coalesced, and also disintegration of once formed coalescent particles can be more surely prevented. As a result, the coalescent particles having a small variation in shape and particle diameter among the particles can be efficiently obtained.

A peripheral velocity of the stirring blade is preferably from 0.1 to 10 m/sec, more preferably from 0.2 to 8 m/sec, further more preferably from 0.2 to 6 m/sec. When the peripheral velocity of the stirring blade falls within the above-mentioned range, the added electrolyte can be uniformly dispersed or dissolved, and the occurrence of uneven electrolyte concentration can be surely prevented. Further, the dispersoids can be more efficiently coalesced, and also disintegration of once formed coalescent particles can be more surely prevented.

An average particle diameter of the resulting coalescent particles is preferably from 0.5 to 5 μm, more preferably from 1.5 to 3 μm. According to this, the particle diameter of the finally obtained toner particles can be made adequate.

Solvent Removal Step

Thereafter, the organic solvent contained in the dispersion liquid is removed. According to this, resin fine particles (tonerparticles) dispersed in the dispersion liquid can be obtained.

The removal of the organic solvent may be performed by any method. However, for example, it can be performed under reduced pressure. According to this, the organic solvent can be efficiently removed while sufficiently preventing degeneration, etc. of the constituent material such as resin material.

Further, a treatment temperature in this step is preferably lower than the glass transition point (Tg) of the resin material constituting the coalescent particles.

Further, this step may be performed in a state in which an antifoaming agent is added to the dispersion liquid. According to this, the organic solvent can be efficiently removed.

As the antifoaming agent, for example, a lower alcohol, a higher alcohol, an oil and fat, a fatty acid, a fatty acid ester, a phosphoric acid ester or the like as well as a mineral oil antifoaming agent, a polyether antifoaming agent, or a silicone antifoaming agent can be used.

An addition amount of the antifoaming agent is not particularly limited, however, it is preferably from 20 to 300 ppm by weight, more preferably from 30 to 100 ppm by weight based on the solid content in the dispersion liquid.

Further, in this step, at least a portion of the aqueous liquid may be removed along with the organic solvent.

Further, in this step, it is not necessary that all the organic solvent (the total amount of the organic solvent contained in the dispersion liquid) should be removed. Even if all the organic solvent is not removed, the remaining organic solvent can be sufficiently removed in another step mentioned below.

Washing Step

Subsequently, the thus obtained resin fine particles (toner particles) are washed (washing step).

By performing this step, even in the case where an organic solvent and the like are contained as impurities, these can be efficiently removed. As a result, the total volatile organic compound (TVOC) concentration in the finally obtained resin fine particles can be made extremely low.

This step can be performed by, for example, separating the resin fine particles through solid-liquid separation (separation from the aqueous liquid), and thereafter redispersing the solid matter (resin fine particles) in water and then performing solid-liquid separation (separation of the resin fine particles from the aqueous liquid). The procedure of redispersion of the solid matter in water and solid-liquid separation may be repeated more than once.

Drying Step

Thereafter, by subjecting the thus obtained resin fine particles to a drying treatment, toner particles can be obtained (drying step).

The drying step can be performed using, for example, a vacuum dryer (such as Ribocone (manufactured by Okawara MFG. CO., LTD.) or Nauta mixer (manufactured by Hosokawa Micron Corporation)), a fluidized bed dryer (manufactured by Okawara MFG. CO., LTD.) or the like.

Dispersion Step

Subsequently, the thus obtained toner particles and the respective dispersants as described above are dispersed in the insulating liquid, whereby the liquid developer is obtained.

The dispersion of the toner particles and the respective dispersants in the insulating liquid may be performed by any method, and can be performed by, for example, mixing the insulating liquid, the toner particles, and the respective dispersants using a bead mill, a ball mill, or the like. By mixing these components through such a method, the dispersants can be more surely adhered or adsorbed to the surface of the toner particles.

Further, in this dispersion step, a component other than the insulating liquid, the toner particles, and the respective dispersants may be mixed.

Further, the dispersion of the toner particles and the respective dispersants in the insulating liquid may be performed using the total amount of the insulating liquid constituting the finally obtained liquid developer or using a portion of the insulating liquid.

In the case where the toner particles and the respective dispersants are dispersed using a portion of the insulating liquid, after completion of the dispersion, the same liquid as used in the dispersion may be added as the insulating liquid, or a liquid different from the liquid used in the dispersion may be added as the insulating liquid. In the latter case, the properties such as viscosity of the finally obtained liquid developer can be easily controlled. Further, when the liquid to be used in the dispersion is a fatty acid monoester, the toner particles can be more surely plasticized.

When the liquid developer is produced by the method as described above, the constituent components of the toner particles contained in the liquid developer are uniformly dispersed and a variation in shape among the toner particles becomes small. Accordingly, a particle surface area does not vary among the particles and the respective dispersants as described above can be more uniformly adhered or adsorbed to the surface of the toner particles. As a result, a variation in charging characteristic among the toner particles can be effectively prevented and also the constitution in the development and transfer processes can be facilitated.

Image Forming Apparatus

Subsequently, a preferred embodiment of an image forming apparatus according to the invention will be described. The image forming apparatus according to the invention forms a color image on a recording medium using the liquid developer of the invention as described above.

Figure 2:
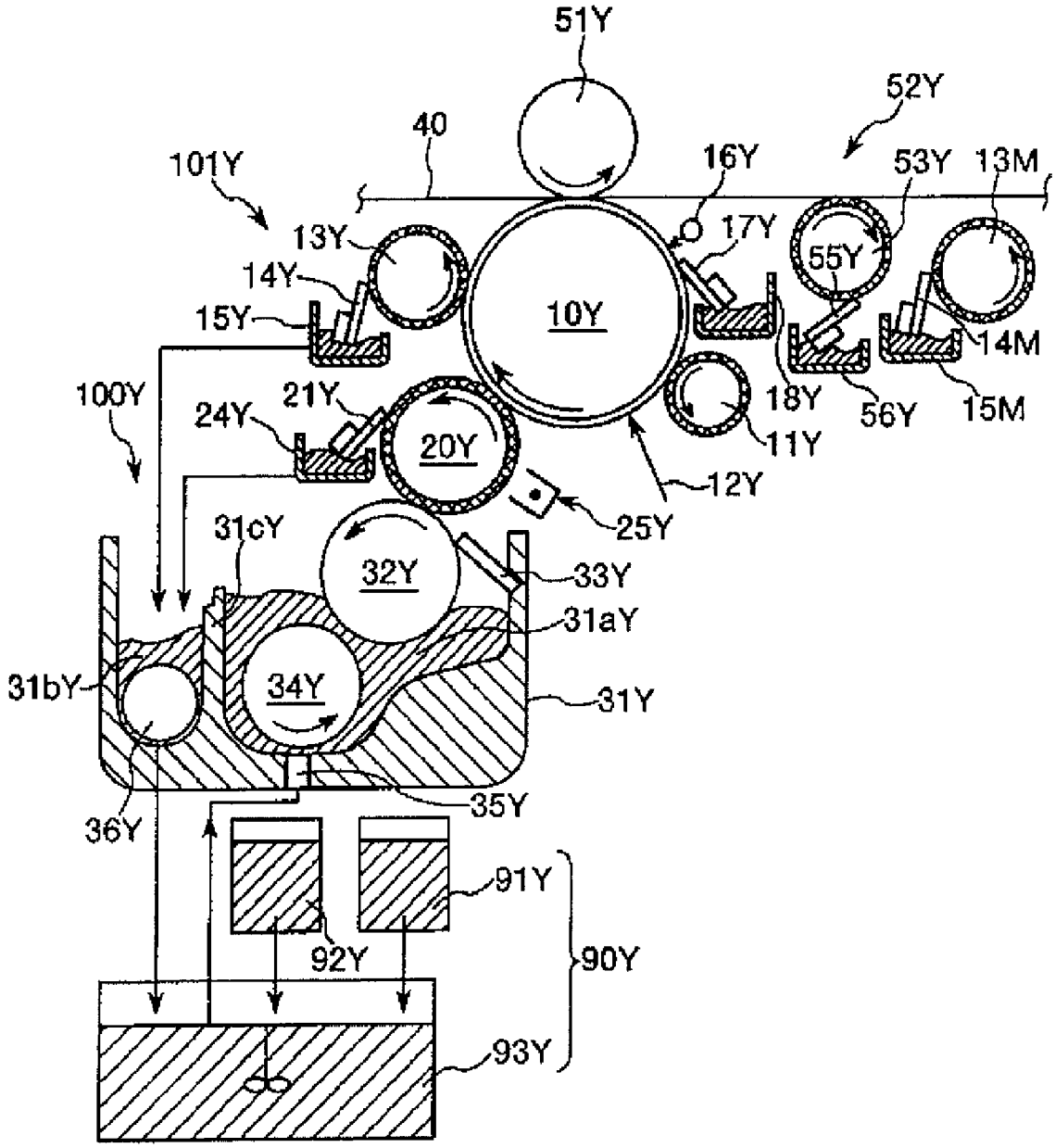
FIG. 2 is an enlarged view showing a part of the image forming apparatus shown in FIG. 1.
Figure 3:
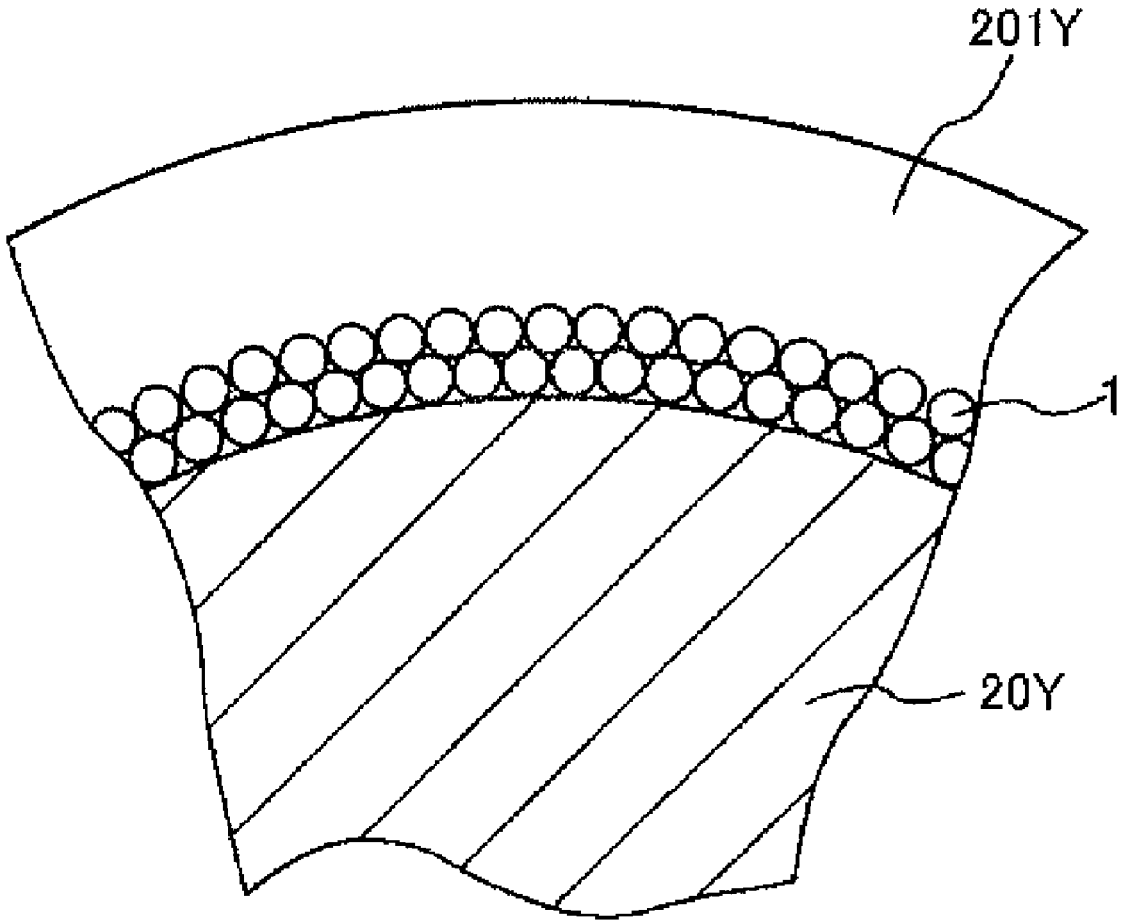
FIG. 3 is a schematic view showing a state of toner particles in a liquid developer layer on a developing roller.

FIG. 1 is a schematic view showing an image forming apparatus to which the liquid developer of the invention is applied; FIG. 2 is an enlarged view showing a part of the image forming apparatus shown in FIG. 1; and FIG. 3 is a schematic view showing a state of toner particles in a liquid developer layer on a developing roller.

As shown in FIGS. 1 and 2, an image forming apparatus 1000 has four developing units 30Y, 30M, 30C, and 30K, an intermediate transfer unit 40, a secondary transfer unit 60, a fixing unit (fixing device) F40, and four liquid developer supply sections 90Y, 90M, 90C, and 90K.

The developing units 30Y, 30M, and 30C have a function of developing latent images with a yellow liquid developer (Y), a magenta liquid developer (M), and a cyan liquid developer (C), respectively, to form monochrome images corresponding to the respective colors. Further, the developing unit 30K has a function of developing a latent image with a black liquid developer (K) to form a black monochrome image.

The developing units 30Y, 30M, 30C, and 30K have the same constitution, and therefore, the developing unit 30Y will be described below.

As shown in FIG. 2, the developing unit 30Y has a photoreceptor 10Y as an example of an image carrying member, and has, along the rotating direction of the photoreceptor 10Y, a charging roller 11Y, an exposure unit 12Y, a developing unit 100Y, a photoreceptor squeeze device 101Y, a primary transfer backup roller 51Y, a charge removal unit 16Y, a photoreceptor cleaning blade 17Y, and a developer recovery section 18Y.

The photoreceptor 10Y has a tubular substrate and a photoreceptor layer which is formed on an outer peripheral surface of the tubular substrate and made of a material such as amorphous silicon, and is rotatable about the center axis thereof. In this embodiment, the photoreceptor 10Y rotates clockwise as shown by the arrow in FIG. 2.

The liquid developer is fed to the photoreceptor 10Y from the developing unit 100Y mentioned below, and a layer of the liquid developer is formed on the surface thereof.

The charging roller 11Y is a device for charging the photoreceptor 10Y, and the exposure unit 12Y is a device for forming a latent image on the charged photoreceptor 10Y by irradiating laser light. The exposure unit 12Y has a semiconductor laser, a polygonal mirror, an F-θ lens, and the like, and irradiates the charged photoreceptor 10Y with laser light modulated based on image signals input from a host computer (not shown) such as a personal computer or a word processor.

The developing unit 100Y is a device for developing a latent image formed on the photoreceptor 100Y with the liquid developer of the invention. The developing unit 100Y will be described in detail below.

The photoreceptor squeeze device 101Y is disposed to face the photoreceptor 10Y on the downstream side of the developing unit 100Y in the rotating direction, and is constituted by a photoreceptor squeeze roller 13Y, a cleaning blade 14Y that is in press-contact with the photoreceptor squeeze roller 13Y and removes the liquid developer adhered to the surface of the photoreceptor squeeze roller 13Y, and a developer recovery section 15Y that recovers the liquid developer removed by the cleaning blade 14Y. The photoreceptor squeeze device 101Y has a function of recovering an excess carrier (insulating liquid) and an essentially unnecessary fogging toner from the developer having been developed on the photoreceptor 10Y to increase a proportion of the toner particles in the developed image.

The primary transfer backup roller 51Y is a device for transferring the monochrome image formed on the photoreceptor 10Y to an intermediate transfer unit 40 mentioned below.

The charge removal unit 16Y is a device for removing remaining charge on the photoreceptor 10Y after transferring the intermediate transfer image to the intermediate transfer unit 40 by the primary transfer backup roller 51Y.

The photoreceptor cleaning blade 17Y is a rubber member in contact with the surface of the photoreceptor 10Y and has a function of scraping and removing the liquid developer remaining on the photoreceptor 10Y after transferring the image to the intermediate transfer unit 40 by the primary transfer backup roller 51Y.

The developer recovery section 18Y has a function of recovering the liquid developer removed by the photoreceptor cleaning blade 17Y.

The intermediate transfer unit 40 is an endless elastic belt member and is tensioned by a belt driving roller 41 to which a driving force of a driving motor (not shown) is transmitted and a pair of driven rollers 44 and 45. Further, the intermediate transfer unit 40 is rotationally driven in a counterclockwise direction by the belt driving roller 41 in contact with the photoreceptors 10Y, 10M, 10C, and 10K at respective positions of the primary transfer backup rollers 51Y, 51M, 51C, and 51K.

A predetermined tension is applied to the intermediate transfer unit 40 by a tension roller 49 so that the intermediate transfer unit 40 is prevented from loosening. The tension roller 49 is disposed on the downstream side of the driven roller 44 in the rotating (moving) direction of the intermediate transfer unit 40 and on the upstream side of the other driven roller 45 in the rotating (moving) direction of the intermediate transfer unit 40.

Monochrome images corresponding to the respective colors formed in the developing units 30Y, 30M, 30C, and 30K are transferred sequentially to the intermediate transfer unit 40 by the primary transfer backup rollers 51Y, 51M, 51C, and 51K, and the monochrome images corresponding to the respective colors are superimposed on one another. In this manner, a full color developer image (intermediate transfer image) is formed on the intermediate transfer unit 40.

The intermediate transfer unit 40 carries the monochrome images formed on the plural photoreceptors 10Y, 10M, 10C, and 10K in a state that these images are successively secondarily transferred so as to be superimposed on one another, and the superimposed images are secondarily transferred at one time to a recoding medium F5 such as paper, film or cloth by a secondary transfer unit 60 mentioned below. In the meantime, when the toner image is transferred to the recording medium F5 in the secondary transfer process, there is a case that the recording medium F5 is not a flat sheet material due to fibers thereof. Therefore, as a method for increasing a secondary transfer characteristic for such a non-flat sheet material, an elastic belt member is employed.

Further, the intermediate transfer unit 40 is provided with a cleaning device including an intermediate transfer unit cleaning blade 46, a developer recovery section 47, and a non-contact type bias applying member 48.

The intermediate transfer unit cleaning blade 46 and the developer recovery section 47 are disposed on a side of the driven roller 45.

The intermediate transfer unit cleaning blade 46 has a function of scraping and removing the liquid developer adhered to the intermediate transfer unit 40 after transferring the image to the recording medium F5 by the secondary transfer unit 60.

The developer recovery section 47 has a function of recovering the liquid developer removed by the intermediate transfer unit cleaning blade 46.

The non-contact type bias applying member 48 is disposed apart from the intermediate transfer unit 40 at a position facing the tension roller 49. The non-contact type bias applying member 48 applies a bias voltage having a polarity opposite to that of the toner (solid matter) of the liquid developer remaining on the intermediate transfer unit 40 after the secondary transfer to the toner. This can remove electric charge from the remaining toner to decrease the electrostatic adhesion force of the toner to the intermediate transfer unit 40. In this example, a corona charging device is used as the non-contact type bias applying member 48.

In this connection, the non-contact type bias applying member 48 may not be necessarily disposed at the position facing the tension roller 49 and can be disposed at an arbitrary position on the downstream side of the driven roller 44 in the moving direction of the intermediate transfer unit 40 and on the upstream side of the other driven roller 45 in the moving direction of the intermediate transfer unit 40 such as a position between the driven roller 44 and the tension roller 49. Further, as the non-contact type bias applying member 48, any known non-contact type charging device other than the corona charging device can also be used.

Further, an intermediate transfer unit squeeze device 52Y is disposed on the downstream side of the primary transfer backup roller 51Y in the moving direction of the intermediate transfer unit 40.

The intermediate transfer unit squeeze device 52Y is provided as a device for removing the excess insulating liquid from the liquid developer transferred to the intermediate transfer unit 40 in the case where the transferred liquid developer is not in a favorable dispersed state.

The intermediate transfer unit squeeze device 52Y is constituted by an intermediate transfer unit squeeze roller 53Y, an intermediate transfer unit squeeze cleaning blade 55Y that is in press-contact with the intermediate transfer unit squeeze roller 53Y and cleans the surface thereof, and a developer recovery section 56Y that recovers the liquid developer removed by the intermediate transfer unit squeeze cleaning blade 55Y.

The intermediate transfer unit squeeze device 52Y has a function of recovering the excess insulating liquid from the developer primarily transferred to the intermediate transfer unit 40 to increase a proportion of the toner particles in the developed image, and also recovering an essentially unnecessary fogging toner.

The secondary transfer unit 60 has a pair of secondary transfer rollers disposed apart from each other at a predetermined distance along in the moving direction of the transfer member. Between these two secondary transfer rollers, a secondary transfer roller disposed on the upstream side in the moving direction of the intermediate transfer unit 40 is an upstream side secondary transfer roller 64. This upstream side secondary transfer roller 64 can come in press-contact with the belt driving roller 41 via the intermediate transfer unit 40.

In addition, between these two secondary transfer rollers, a secondary transfer roller disposed on the downstream side in the moving direction of the transfer member is a downstream side secondary transfer roller 65. This downstream side secondary transfer roller 65 can come in press-contact with the driven roller 44 via the intermediate transfer unit 40.

That is, the upstream side secondary transfer roller 64 and the downstream side secondary transfer roller 65 each bring the recording medium F5 into contact with the intermediate transfer unit 40 which is tensioned by the belt driving roller 41 and the driven roller 44 and secondarily transfer the intermediate transfer image formed on the intermediate transfer unit 40 by superimposing the monochrome images to the recording medium F5.

In this case, the belt driving roller 41 and the driven roller 44 also function as backup rollers for the upstream side secondary transfer roller 64 and the downstream side secondary transfer roller 65, respectively. That is, the belt driving roller 41 also serves as an upstream side backup roller disposed on the upstream side of the driven roller 44 in the moving direction of the recording medium F5 in the secondary transfer unit 60. Further, the driven roller 44 also serves as a downstream side backup roller disposed on the downstream side of the belt driving roller 41 in the moving direction of the recording medium F5 in the secondary transfer unit 60.

Therefore, the recording medium F5 transported to the secondary transfer unit 60 is brought into close contact with the intermediate transfer unit 40 in a predetermined moving region of the transfer member from a position at which press-contact between the upstream side secondary transfer roller 64 and the belt driving roller 41 starts (nip start position) to a position at which press-contact between the downstream side secondary transfer roller 65 and the driven roller 44 ends (nip end position). Accordingly, the full color intermediate transfer image on the intermediate transfer unit 40 is secondarily transferred to the recording medium F5 in a state of being in close contact with the intermediate transfer unit 40 over a predetermined time, and thus, a favorable secondary transfer can be achieved.

Further, the secondary transfer unit 60 includes a secondary transfer roller cleaning blade 66 and a developer recovery section 67 with respect to the upstream side secondary transfer roller 64 and also includes a secondary transfer roller cleaning blade 68 and a developer recovery section 69 with respect to the downstream side secondary transfer roller 65. The secondary transfer roller cleaning blades 66 and 68 are in contact with the secondary transfer rollers 64 and 65, respectively, and scrape and remove the liquid developer remaining on the surface of the secondary transfer rollers 64 and 65, respectively, after secondary transfer. Further, the developer recovery sections 67 and 69 each recover and store the liquid developer scraped and removed from the respective secondary transfer rollers 64 and 65 by the respective secondary transfer roller cleaning blades 66 and 68.

The toner image (transfer image) transferred to the recording medium F5 by the secondary transfer unit 60 is transported to a fixing unit (fixing device) F40 and fixed on the recording medium F5 by heating and pressing.

Specifically, a fixing temperature is preferably from 80 to 160° C., more preferably from 100 to 150° C., further more preferably from 100 to 140° C.

Subsequently, the developing units 100Y, 100M, 100C, and 100K will be described in detail. In the following description, the developing unit 100Y will be described as a representative example.

As shown in FIG. 2, the developing unit 100Y has a liquid developer reservoir section 31Y, a coating roller 32Y, a control blade 33Y, a developer stirring roller 34Y, a communication channel 35Y, a recovery screw 36Y, a developing roller 20Y, a developing roller cleaning blade 21Y, and a corona discharging device (compressing unit) 25Y.

The liquid developer reservoir section 31Y has a function of reserving the liquid developer for developing a latent image formed on the photoreceptor 10Y and is provided with a feed section 31*a*Y that feeds the liquid developer to the developing unit, a recovery section 31*b*Y that recovers the excess liquid developer occurring in the feed section 31*a*Y and the like, and a partition 31*c*Y that separates the feed section 31*a*Y and the recovery section 31*b*Y.

The feed section 31*a*Y has a function of feeding the liquid developer to the coating roller 32Y and has a concave portion in which the developer stirring roller 34Y is installed. Further, to the feed section 31*a*Y, the liquid developer is fed through the communication channel 35Y from a liquid developer mixing bath 93Y.

The recovery section 31*b*Y recovers the liquid developer excessively fed to the feed section 31*a*Y and the excess liquid developer occurring in the developer recovery sections 15Y and 24Y. The recovered liquid developer is transported to the liquid developer mixing bath 93Y mentioned below for reuse. Further, the recovery section 31*b*Y has a concave portion and a recovery screw 36Y is installed in the vicinity of the bottom of the concave portion.

At the boundary between the feed section 31*a*Y and the recovery section 31*b*Y, the wall-like partition 31*c*Y is provided. The partition 31*c*Y separates the feed section 31*a*Y and the recovery section 31*b*Y and can prevent contamination of the fresh liquid developer with the recovered liquid developer. Further, when the liquid developer is excessively fed to the feed section 31*a*Y, the excess liquid developer can be allowed to overflow from the feed section 31*a*Y to the recovery section 31*b*Y across the partition 31*c*Y. Therefore, the amount of the liquid developer in the feed section 31*a*Y can be maintained constant, and the amount of the liquid developer to be fed to the coating roller 32Y can be maintained constant. As a result, the quality of the finally formed image becomes stable.

Further, the partition 31*c*Y has a notch, and the liquid developer can be allowed to overflow from the feed section 31*a*Y to the recovery section 31*b*Y through the notch.

The coating roller 32Y has a function of feeding the liquid developer to the developing roller 20Y.

The coating roller 32Y is a so-called anilox roller which is a roller made of a metal such as iron, having grooves formed uniformly and spirally on the surface thereof and having been plated with nickel, and has a diameter of about 25 mm. In this embodiment, plural grooves are formed slantwise with respect to the rotating direction of the coating roller 32Y by a so-called cutting process, rolling process, or the like. The coating roller 32Y is in contact with the liquid developer while rotating counterclockwise to retain the liquid developer in the feed section 31*a*Y in the grooves, and transports the retained liquid developer to the developing roller 20Y.

The control blade 33Y is in contact with the surface of the coating roller 32Y to control the amount of the liquid developer on the coating roller 32Y. That is, the control blade 33Y plays a role in measuring an amount of the liquid developer on the coating roller 32Y to be fed to the developing roller 20Y by scraping and removing the excess liquid developer on the coating roller 32Y. This control blade 33Y is formed of urethane rubber as an elastic material and supported by a control blade supporting member made of a metal such as iron. The control blade 33Y is disposed on a side where the coating roller 32Y rotates and comes out from the liquid developer (i.e., on a right side in FIG. 2). The control blade 33Y has a rubber hardness of about 77 according to JIS-A, and the hardness of the control blade 33Y at the part in contact with the surface of the coating roller 32Y (about 77) is lower than that of the elastic layer of the developing roller 20Y mentioned below at the part in press-contact with the surface of the coating roller 32Y (about 85). Further, the excess liquid developer thus scraped off is recovered in the feed section 31*a*Y for reuse.

The developer stirring roller 34Y has a function of stirring the liquid developer to form a uniformly dispersed state. According to this, even in the case where plural toner particles 1 are aggregated, the respective toner particles 1 can be favorably dispersed. In particular, the liquid developer of the invention includes the toner particles having high dispersibility, therefore, the toner particles can be more favorably dispersed. In addition, even in the case of the reused liquid developer, the toner particles can be easily dispersed.

In the feed section 31*a*Y, the toner particles 1 in the liquid developer have a positive charge, and the liquid developer is in a uniformly dispersed state by stirring with the developer stirring roller 34Y and is drawn up from the liquid developer reservoir section 31Y through rotation of the coating roller 32Y, and then fed to the developing roller 20Y after controlling the amount of the liquid developer by the control blade 33Y. Further, through stirring of the liquid developer by the developer stirring roller 34Y, the liquid developer can be allowed to stably overflow across the partition 31*c*Y to the side of the recovery section 31*b*Y, whereby the liquid developer is prevented from being retained and compressed.

Further, the developer stirring roller 34Y is installed in the vicinity of the communication channel 35Y. Therefore, the liquid developer fed from the communication channel 35Y can be promptly diffused, and even in the case where the liquid developer is being supplied to the feed section 31$a$Y, the level of the liquid in the feed section 31$a$Y can be maintained constant. By installing such a developer stirring roller 34Y in the vicinity of the communication channel 35Y, a negative pressure is generated in the communication channel 35Y, and therefore, the liquid developer can be naturally sucked up.

The communication channel 35Y is provided vertically beneath the developer stirring roller 34Y and communicates with the liquid developer reservoir section 31Y, and through which the liquid developer is sucked up from the liquid developer mixing bath 93Y to feed section 31$a$Y.

By installing the communication channel 35Y beneath the developer stirring roller 34Y, the liquid developer fed through the communication channel 35Y is held back by the developer stirring roller 34Y and the level of the liquid is prevented from rising due to ejection of the liquid developer and the liquid level is maintained substantially constant, whereby the liquid developer can be stably fed to the coating roller 32Y.

The recovery screw 36Y installed in the vicinity of the bottom of the recovery section 31$b$Y is formed of a cylindrical material, has spiral ribs on the outer periphery thereof, and has a function of maintaining the fluidity of the recovered liquid developer and also has a function of accelerating the transport of the liquid developer to the liquid developer mixing bath 93Y.

The developing roller 20Y retains the liquid developer and transports it to the developing position facing the photoreceptor 10Y for developing the latent image carried on the photoreceptor 10Y with the liquid developer.

The developing roller 20Y has a liquid developer layer 201Y formed on the surface thereof by feeding the liquid developer from the coating roller 32Y.

The developing roller 20Y includes an inner core made of a metal such as iron and an electroconductive elastic layer on the outer periphery of the core, and has a diameter of about 20 mm. The elastic layer has a two-layer structure including a urethane rubber layer having a rubber hardness of about 30 according to JIS-A and a thickness of about 5 mm as an inner layer, and a urethane rubber layer having a rubber hardness of about 85 according to JIS-A and a thickness of about 30 μm as a surface (outer) layer. The developing roller 20Y is in press-contact with the coating roller 32Y and the photoreceptor 10Y while the surface layer is serving as a press-contact portion in an elastically deformed state.

Further, the developing roller 20Y is rotatable about the center axis thereof, and the center axis is located down below the rotation center axis of the photoreceptor 10Y. The developing roller 20Y rotates in the direction (i.e., the counterclockwise direction in FIG. 2) opposite to the rotating direction (i.e., the clockwise direction in FIG. 2) of the photoreceptor 10Y. When the latent image formed on the photoreceptor 10Y is developed, an electric field is generated between the developing roller 20Y and the photoreceptor 10Y.

The corona discharging device (compressing unit) 25Y is a device having a function of making the toner in the liquid developer retained by the developing roller 20Y into a compressed state. In other words, the corona discharging device 25Y is a device having a function of applying an electric field having the same polarity as the toner particles 1 to the liquid developer layer 201Y thereby localizing the toner particles 1 in the vicinity of the surface of the developing roller 20Y in the liquid developer layer 201Y as shown in FIG. 3. By localizing the toner particles in this manner, the developing density (developing efficiency) can be improved, and as a result, a sharp and high-quality image can be obtained.

In the developing unit 100Y, the coating roller 32Y is driven by a power source (not shown) which is difference from a power source (not shown) for driving the developing roller 20Y. Therefore, by changing a ratio of a rotational speed (linear velocity) of the application roller 32Y to that of the developing roller 20Y, an amount of the liquid developer to be fed on the developing roller 20Y can be adjusted.

Further, the developing unit 100Y has a developing roller cleaning blade 21Y made of rubber and provided in contact with the surface of the developing roller 20Y and a developer recovery section 24Y. The developing roller cleaning blade 21Y is a device for scraping and removing the liquid developer remaining on the developing roller 20Y after the development of an image is carried out at the developing position. The liquid developer removed by the developing roller cleaning blade 21Y is recovered in the developer recovery section 24Y.

As shown in FIGS. 1 and 2, the image forming apparatus 1000 is further provided with liquid developer supply sections 90Y, 90M, 90C, and 90K which supply the liquid developers to the developing units 30Y, 30M, 30C, and 30K, respectively. These liquid developer supply sections 90Y, 90M, 90C, and 90K have liquid developer tanks 91Y, 91M, 91C, and 91K, insulating liquid tanks 92Y, 92M, 92C, and 92K, and liquid developer mixing baths 93Y, 93M, 93C, and 93K, respectively.

In each of the liquid developer tanks 91Y, 91M, 91C, and 91K, a liquid developer of high concentration which corresponds to each of the different colors is stored. Further, in each of the insulating liquid tanks 92Y, 92M, 92C, and 92K, the insulating liquid is stored. Further, to each of the liquid developer mixing baths 93Y, 93M, 93C, and 93K, a predetermined amount of each liquid developer of high concentration is fed from each of the liquid developer tanks 91Y, 91M, 91C, and 91K and a predetermined amount of each insulating liquid is fed from each of the insulating liquid tanks 92Y, 92M, 92C, and 92K.

In each of the liquid developer mixing baths 93Y, 93M, 93C, and 93K, the fed liquid developer of high concentration and the fed insulating liquid are mixed while stirring by a stirrer installed in each bath to prepare a liquid developer corresponding to each of the different colors which is to be used in each of the feed sections 31$a$Y, 31$a$M, 31$a$C, and 31$a$K. The liquid developers prepared in the respective liquid developer mixing baths 93Y, 93M, 93C, and 93K are fed to the corresponding feed sections 31$a$Y, 31$a$M, 31$a$C, and 31$a$K, respectively.

Further, in the liquid developer mixing bath 93Y, the liquid developer recovered by the recovery section 31$b$Y is recovered for reuse. The same shall apply to the liquid developer mixing baths 93M, 93C, and 93K.

In the above, the invention is described based on preferred embodiments, however, the invention is not limited to these embodiments.

For example, the liquid developer of the invention is not limited to those applied to the image forming apparatus as described above.

Further, the liquid developer of the invention is not limited to those produced by the production method as described above.

Further, in the above-mentioned embodiments, coalescent particles are obtained by preparing an aqueous emulsion liquid and adding an electrolyte to the prepared aqueous emulsion liquid, however, the invention is not limited thereto. For example, the coalescent particles may be prepared using an emulsion polymerization association method in which a colorant, a monomer, a surfactant, and a polymerization initiator are dispersed in an aqueous liquid, and an aqueous emulsion liquid is prepared by an emulsion polymerization, and then an electrolyte is added to the aqueous emulsion liquid to effect association. Further, the coalescent particles may be prepared by subjecting the obtained aqueous emulsion liquid to spray drying.

Further, in the above-mentioned embodiments, the image forming apparatus including a corona discharging device is described, however, the apparatus may not include a corona discharging device.

EXAMPLES

1. Production of Liquid Developer

A liquid developer was produced as described below.

Example 1

First, toner particles were produced. Steps in which a temperature is not specified were performed at room temperature (25° C.).

Dispersion Liquid Preparation Step

Preparation of Colorant Master Solution

First, 60 parts by weight of a polyester resin (acid value: 10 mgKOH/g, glass transition point (Tg): 55° C., softening point: 107° C.) was prepared as a resin material.

Subsequently, a mixture of the above resin material and a cyan pigment (Pigment Blue 15:3, manufactured by Dainichiseika Color & Chemicals Mfg. Co., Ltd.) as a colorant at a mass ratio of 50:50 was prepared. The components were mixed using a 20-L Henschel mixer, whereby a raw material for producing a toner was obtained.

Then, the raw material (mixture) was kneaded using a twin-screw kneading extruder. The kneaded product extruded from the extrusion port of the twin-screw kneading extruder was cooled.

The thus cooled kneaded product was coarsely pulverized to prepare a colorant master batch having an average particle diameter of 1.0 mm or less. A hammer mill was used for coarse pulverization of the kneaded product.

Resin Liquid Preparation Treatment 175 parts by weight of methyl ethyl ketone, 172.3 parts by weight of the polyester resin, and 55.3 parts by weight of a rosin-modified phenol resin (trade name "KG2212", manufactured by Arakawa Chemical Industries, Ltd., acid value: 22 mg KOH/g or less, softening point: 172 to 182° C., weight average molecular weight: 100000) were mixed in 97.5 parts by weight of the colorant master batch using a high-speed disperser (T.K. Robomix/T.K. Homo Disper Model 2.5, manufactured by Primix Corporation). Then, 1.38 parts by weight of NEOGEN SC-F (manufactured by Dai-ichi Kogyo Seiyaku Co., Ltd.) as an emulsifying agent was added to the mixture to prepare a resin liquid. In this resin liquid, the pigment was uniformly and finely dispersed.

Dispersoid Formation Treatment

Subsequently, 72.8 parts by weight of 1 N ammonia water was added to the resin liquid in a vessel and the mixture was sufficiently stirred using a high-speed disperser (T.K. Robomix/T.K. Homo Disper Model 2.5, manufactured by Primix Corporation) by setting a peripheral velocity of the stirring blade to 7.5 m/s and then, a liquid temperature in the flask was adjusted to 25° C. Thereafter, while stirring the mixture by setting a peripheral velocity of the stirring blade to 14.7 m/s, 400 parts by weight of deionized water was added dropwise thereto to cause phase inversion emulsification. While continuing stirring, 100 parts by weight of deionized water was further added to the resin liquid, whereby an aqueous dispersion liquid in which dispersoids containing the resin material were dispersed was obtained.

Coalescence Step

Subsequently, the aqueous dispersion liquid was transferred to a stirring vessel having a max blend blade, and a temperature of the aqueous dispersion liquid was adjusted to 25° C. while stirring the dispersion liquid by setting a peripheral velocity of the stirring blade to 1.0 m/s.

Subsequently, coalescent particles were formed by adding 200 parts by weight of a 5.0% aqueous solution of sodium sulfate dropwise to the dispersion liquid while maintaining the same temperature and stirring conditions to coalesce the dispersoids. After the dropwise addition, the mixture was kept stirring until toner particles of the coalescent particles were grown to have a 50% volume particle diameter Dv(50) (μm) of 3.5 μm. When the Dv(50) of the coalescent particles reached 3.5 μm, 200 parts by weight of deionized water was added and coalescence was finished.

Solvent Removal Step

The organic solvent was distilled off from the thus obtained coalescent particle dispersion liquid under reduced pressure until the solid content became 23 wt %, whereby a resin fine particle slurry was obtained.

Washing Step

Subsequently, the thus obtained slurry was subjected to solid-liquid separation, and further a procedure of redispersion in water (reslurry) and solid-liquid separation was performed repeatedly to effect a washing treatment. Then, the washed slurry was subjected to suction filtration, whereby a wet cake of colored resin fine particles (resin fine particle cake) was obtained. A content of water in the wet cake was 35 wt %.

Drying Step

Thereafter, the thus obtained wet cake was dried using a vacuum dryer, whereby toner particles were obtained.

Dispersion Step 37.5 parts by weight of the toner particles obtained by the above-mentioned method, 0.24 parts by weight of an alkyl diamine (trade name "Duomin CD", manufactured by Lion Akzo Co., Ltd., amine value: 437 mg KOH/g) and 0.48 parts by weight of an amide compound having a 12-hydroxystearic acid skeleton (trade name "Solsperse 11200", manufactured by The Lubrizol Corporation) as dispersants, 90 parts by weight of rapeseed oil (trade name "high-oleic rapeseed oil" manufactured by The Nisshin Oillio Group, Ltd.), and 60 parts by weight of soybean oil fatty acid methyl ester (manufactured by The Nisshin Oillio Group, Ltd.) were placed in a ceramic pot (internal capacity: 600 mL), and further zirconia balls (ball diameter: 1 mm) were placed in the ceramic pot such that a volume filling ratio became 85%. Then, the mixture in the pot was dispersed using a desktop pot mill at a rotational speed of 230 rpm for 24 hours, and thus a liquid developer was obtained.

The toner particles in the thus obtained liquid developer had a Dv(50) of 3.2 μm. The 50% volume particle diameter Dv(50) (μm) of the obtained toner particles was measured using a particle analysis apparatus Mastersizer 1000 (manufactured by Malvern Instruments, Ltd.). Also, the particle diameters of particles obtained in the respective Examples and Comparative examples mentioned below were determined in the same manner.

Further, a viscosity of the thus obtained liquid developer at 25° C. was 65 mPa·s.

Further, a magenta liquid developer, a yellow liquid developer, and a black liquid developer were produced in the same manner as described above except that a magenta pigment (Pigment Red 238, manufactured by Sanyo Color Works, Ltd.), a yellow pigment (Pigment yellow 180, manufactured by Clariant), a black pigment (carbon black Printex L, manufactured by Degussa) were used, respectively, instead of the cyan pigment.

Examples 2 to 5

Liquid developers corresponding to the respective colors were produced in the same manner as in Example 1 except that the addition amounts of the dispersants were changed as shown in Table 1.

Example 6

Liquid developers corresponding to the respective colors were produced in the same manner as in Example 1 except that a rosin-modified phenol resin (trade name "Tamanor 135", manufactured by Arakawa Chemical Industries, Ltd., acid value: 18 mg KOH/g or less, softening point: 130 to 140° C., weight average molecular weight: 15000) was used as the rosin-modified resin.

Example 7

Liquid developers corresponding to the respective colors were produced in the same manner as in Example 1 except that a rosin-modified phenol resin (trade name "Tamanor 145", manufactured by Arakawa Chemical Industries, Ltd., acid value: 18 mg KOH/g or less, softening point: 140 to 155° C., weight average molecular weight: 20000) was used as the rosin-modified resin.

Example 8

Liquid developers corresponding to the respective colors were produced in the same manner as in Example 1 except that a rosin-modified maleic resin (trade name "Malkyd No. 1", manufactured by Arakawa Chemical Industries, Ltd., acid value: 25 mg KOH/g or less, softening point: 120 to 130° C., weight average molecular weight: 3100) was used as the rosin-modified resin.

Example 9

Liquid developers corresponding to the respective colors were produced in the same manner as in Example 1 except that Duomin T (manufactured by Lion Akzo Co., Ltd., amine value: 364 mg KOH/g) was used as the alkyl diamine.

Example 10

Liquid developers corresponding to the respective colors were produced in the same manner as in Example 1 except that Asphazol #10 (manufactured by NOF Corporation, amine value: 320 mg KOH/g) was used as the alkyl diamine.

Example 11

Liquid developers corresponding to the respective colors were produced in the same manner as in Example 1 except that Asphazol #20 (manufactured by NOF Corporation, amine value: 325 mg KOH/g) was used as the alkyl diamine.

Examples 12 and 13

Liquid developers corresponding to the respective colors were produced in the same manner as in Example 1 except that a blending ratio of the polyester resin to the rosin resin was changed as shown in Table 1.

Example 14

Liquid developers corresponding to the respective colors were produced in the same manner as in Example 1 except that liquid paraffin (trade name "Cosmo White P-70", manufactured by Cosmo Oil Co., Ltd.) was used as the insulating liquid instead of soybean oil fatty acid methyl ester and rapeseed oil.

Example 15

Liquid developers corresponding to the respective colors were produced in the same manner as in Example 1 except that liquid paraffin (trade name "Cosmo White P-70", manufactured by Cosmo Oil Co., Ltd.) was used instead of rapeseed oil.

Example 16

Liquid developers corresponding to the respective colors were produced in the same manner as in Example 15 except that Solsperse 17000 (manufactured by The Lubrizol Corporation) was used as the amide compound having a hydroxy fatty acid skeleton.

Comparative Example 1

Liquid developers corresponding to the respective colors were produced in the same manner as in Example 1 except that the dispersants (the alkyl diamine and the amide compound having a 12-hydroxystearic acid skeleton) were not added.

Comparative Example 2

Liquid developers corresponding to the respective colors were produced in the same manner as in Example 1 except that the amide compound having a 12-hydroxystearic acid skeleton as the dispersant was not added.

Comparative Example 3

Liquid developers corresponding to the respective colors were produced in the same manner as in Example 1 except that the alkyl diamine as the dispersant was not added.

With regard to the respective Examples and Comparative examples, the compositions of the liquid developers and the like are shown in Table 1. In the table, the polyester resin is denoted by PES; the rosin-modified phenol resin (trade name "KG22121") is denoted by RP1; the rosin-modified phenol resin (trade name "Tamanor 135") is denoted by RP2; the rosin-modified phenol resin (trade name "Tamanor 145") is denoted by RP3; the rosin-modified maleic resin is denoted by RM; the Solsperse is denoted by S; the soybean oil fatty acid methyl ester is denoted by MONO; the rapeseed oil is denoted by VO; and the liquid paraffin is denoted by LP.

TABLE 1

| | Liquid developer | | | | | | | | | | | | |
|---|---|---|---|---|---|---|---|---|---|---|---|---|---|
| | Toner particles | | | | | Dispersant | | | | | | | |
| | | | | | | Alkyl diamine | | Amide compound having a 12-hydroxystearic acid skeleton | | | | | |
| | Resin material | | | | | | Content | | Content | Insulating liquid | | | |
| | Type | Content in resin material (wt %) | Type | Content in resin material (wt %) | Average particle diameter (μm) | Amine value (mg KOH/g) | based on 100 parts by weight of toner particles (parts by weight) | Type | based on 100 parts by weight of toner particles (parts by weight) | Type | Content in insulating liquid (wt %) | Type | Content in insulating liquid (wt %) |
| Example 1 | PES | 80 | RP1 | 20 | 3.2 | 437 | 0.6 | S | 1.2 | VO | 60 | MONO | 40 |
| Example 2 | PES | 80 | RP1 | 20 | 3.1 | 437 | 1.2 | S | 0.6 | VO | 60 | MONO | 40 |
| Example 3 | PES | 80 | RP1 | 20 | 3.0 | 437 | 2.4 | S | 1.8 | VO | 60 | MONO | 40 |
| Example 4 | PES | 80 | RP1 | 20 | 3.2 | 437 | 3.6 | S | 3.6 | VO | 60 | MONO | 40 |
| Example 5 | PES | 80 | RP1 | 20 | 3.1 | 437 | 4.8 | S | 1.2 | VO | 60 | MONO | 40 |
| Example 6 | PES | 80 | RP2 | 20 | 3.0 | 437 | 1.2 | S | 4.8 | VO | 60 | MONO | 40 |
| Example 7 | PES | 80 | RP3 | 20 | 3.1 | 437 | 1.2 | S | 4.8 | VO | 60 | MONO | 40 |
| Example 8 | PES | 80 | RM | 20 | 3.3 | 437 | 1.2 | S | 4.8 | VO | 60 | MONO | 40 |
| Example 9 | PES | 80 | RP1 | 20 | 3.0 | 364 | 1.2 | S | 4.8 | VO | 60 | MONO | 40 |
| Example 10 | PES | 80 | RP1 | 20 | 3.1 | 320 | 1.2 | S | 4.8 | VO | 60 | MONO | 40 |
| Example 11 | PES | 80 | RP1 | 20 | 3.2 | 325 | 1.2 | S | 4.8 | VO | 60 | MONO | 40 |
| Example 12 | PES | 60 | RP1 | 40 | 3.0 | 437 | 1.2 | S | 4.8 | VO | 60 | MONO | 40 |
| Example 13 | PES | 70 | RP1 | 30 | 3.2 | 437 | 1.2 | S | 4.8 | VO | 60 | MONO | 40 |
| Example 14 | PES | 80 | RP1 | 20 | 3.1 | 437 | 1.2 | S | 4.8 | LP | 100 | — | — |
| Example 15 | PES | 80 | RP1 | 20 | 3.3 | 437 | 1.2 | S | 4.8 | LP | 60 | MONO | 40 |
| Example 16 | PES | 80 | RP1 | 20 | 3.2 | 437 | 1.2 | S | 1.2 | LP | 60 | MONO | 40 |
| Comparative example 1 | PES | 80 | RP1 | 20 | 3.0 | — | — | — | — | VO | 60 | MONO | 40 |
| Comparative example 2 | PES | 80 | RP1 | 20 | 3.1 | 437 | 1.2 | — | — | VO | 60 | MONO | 40 |
| Comparative example 3 | PES | 80 | RP1 | 20 | 3.2 | — | — | S | 4.8 | VO | 60 | MONO | 40 |

2. Evaluation

The respective liquid developers obtained as described above were evaluated as follows.

2.1. Development Efficiency

Using an image forming apparatus as shown in FIGS. 1 and 2, a liquid developer layer was formed on the developing roller of the image forming apparatus with each of the liquid developers obtained in the above-mentioned respective Examples and Comparative examples. Subsequently, a surface potential of the developing roller was set to 300 V, and the photoreceptor was uniformly charged so as to have a surface potential of 500 V. Then, the charge of the surface of the photoreceptor was reduced by irradiating the photoreceptor with light thereby decreasing the surface potential thereof to 50 V. The toner particles on the developing roller and the photoreceptor behind the point at which the liquid developer layer passed between the photoreceptor and the developing roller were collected using tapes, respectively. Each tape used for collecting the toner particles was stuck on a recording paper and a density of the toner particles on each tape was measured. After the measurement, a value obtained by dividing the density of the toner particles collected on the photoreceptor by the sum of the densities of the toner particles collected on the photoreceptor and the developing roller and then multiplying the resulting value by 100 was calculated as a development efficiency, which was then evaluated into the following four grades.

A: The development efficiency is 90% or more, and the development efficiency is particularly excellent.

B: The development efficiency is 85% or more and less than 90%, and the development efficiency is excellent.

C: The development efficiency is 80% or more and less than 85%, and there is no practical problem.

D: The development efficiency is less than 80%, and the development efficiency is poor.

2.2. Primary Transfer Efficiency

Using an image forming apparatus as shown in FIGS. 1 and 2, a liquid developer layer was formed on the photoreceptor of the image forming apparatus with each of the liquid developers obtained in the respective Examples and Comparative examples. Subsequently, the toner particles on the photoreceptor and the intermediate transfer unit behind the point at which the liquid developer layer passed between the photoreceptor and the intermediate transfer unit were collected using tapes, respectively. Each tape used for collecting the toner particles was stuck on a recording paper and a density of the toner particles on each tape was measured. After the measurement, a value obtained by dividing the density of the toner particles collected on the intermediate transfer unit by the sum of the densities of the toner particles collected on the photoreceptor and the intermediate transfer unit and then multiplying the resulting value by 100 was determined to be a primary transfer efficiency, which was then evaluated into the following four grades.

A: The primary transfer efficiency is 90% or more, and the primary transfer efficiency is particularly excellent.

B: The primary transfer efficiency is 85% or more and less than 90%, and the primary transfer efficiency is excellent.

C: The primary transfer efficiency is 80% or more and less than 85%, and there is no practical problem.

D: The primary transfer efficiency is less than 80%, and the primary transfer efficiency is poor.

2.3. Secondary Transfer Efficiency

Using an image forming apparatus as shown in FIGS. 1 and 2, a toner image was formed on the intermediate transfer unit of the image forming apparatus with each of the liquid developers obtained in the respective Examples and Comparative examples. Subsequently, the toner particles on the intermediate transfer unit behind the point at which the toner image passed between the intermediate transfer unit and a recording paper (high quality paper LPCPPA4, manufactured by Seiko Epson Corporation) were collected. The tape used for collecting the toner particles was stuck on a recording paper other than the above paper and a density of the toner particles on the tape was measured. On the other hand, a density of the toner particles on the recording paper to which the toner image was transferred from the intermediate transfer unit was also measured. After the measurement, a value obtained by dividing the density of the toner particles on the recording paper to which the toner image was transferred from the intermediate transfer unit by the sum of the density of the toner particles collected on the intermediate transfer unit and the density of the toner particles on the recording paper to which the toner image was transferred from the intermediate transfer unit and then multiplying the resulting value by 100 was determined to be a secondary transfer efficiency, which was then evaluated into the following four grades.

A: The secondary transfer efficiency is 70% or more, and the secondary transfer efficiency is particularly excellent.

B: The secondary transfer efficiency is 60% or more and less than 70%, and the secondary transfer efficiency is excellent.

C: The secondary transfer efficiency is 55% or more and less than 60%, and there is no practical problem.

D: The secondary transfer efficiency is less than 55%, and the secondary transfer efficiency is poor.

2.4. Positive Charging characteristic

A potential difference of each of the liquid developers obtained in the respective Examples and Comparative examples was measured using a microscope laser zeta potentiometer "ZC-2000" manufactured by Microtec Nition Corporation, which was then evaluated into the following five grades.

The measurement was performed as follows. Each liquid developer was diluted with a dilution solvent and placed in a transparent 10×10 mm square cell. Then, a voltage of 300 V was applied between electrodes (distance of electrodes: 9 mm), and at the same time, movement of the particles in the cell was observed with a microscope to calculate their moving speed, and a zeta potential was obtained based on the calculated moving speed value.

A: The potential difference is +100 mV or more (very good).

B: The potential difference is +85 mV or more and less than +100 mV (good).

C: The potential difference is +70 mV or more and less than +85 mV (moderate).

D: The potential difference is +50 mV or more and less than +70 mV (somewhat bad).

E: The potential difference is less than +50 mV (very bad).

2.5. Dispersion Stability Test 1

10 mL of each of the liquid developers obtained in the respective Examples and Comparative examples was placed in a test tube (diameter: 12 mm, length: 120 mm), and the test tube was left stand for 1 week. Then, a depth of sediment was measured, which was evaluated into the following four grades.

A: The depth of sediment is 0 mm.

B: The depth of sediment is more than 0 mm and 2 mm or less.

C: The depth of sediment is more than 2 mm and 5 mm or less.

D: The depth of sediment is more than 5 mm.

2.6. Dispersion Stability Test 2

45.5 mL of each of the liquid developers obtained in the respective Examples and Comparative examples was placed in a centrifuge tube and centrifuged at a load of 900 G for 60 seconds using a centrifuge (manufactured by Kokusan Co., Ltd.). Then, a depth of sediment was measured. From the thus obtained depth of sediment, a sedimentation speed S (m/s) was calculated, which was evaluated into the following four grades.

A: $S \leqq 3.0\times10^{-4}$

B: $3.0\times10^{-4} < S \leqq 9.0\times10^{-4}$

C: $9.0\times10^{-4} < S \leqq 1.0\times10^{-3}$

D: $1.0\times10^{-3} < S$

These results are shown in Table 2.

TABLE 2

| | Development efficiency | Primary transfer efficiency | Secondary transfer efficiency | Positive charging characteristic | Dispersion stability 1 | Dispersion stability 2 |
|---|---|---|---|---|---|---|
| Example 1 | A | A | A | A | A | A |
| Example 2 | A | B | B | B | B | B |
| Example 3 | B | B | B | A | A | A |
| Example 4 | B | B | B | B | A | B |
| Example 5 | B | B | B | B | A | A |
| Example 6 | A | A | A | A | A | A |
| Example 7 | A | A | A | A | A | A |
| Example 8 | A | A | A | A | A | A |
| Example 9 | A | A | A | B | A | A |
| Example 10 | A | B | B | B | A | A |
| Example 11 | A | A | B | B | A | A |
| Example 12 | B | B | B | B | A | A |
| Example 13 | A | B | B | B | A | A |
| Example 14 | B | B | B | B | B | B |
| Example 15 | A | A | A | A | B | B |
| Example 16 | A | A | A | A | B | B |
| Comparative example 1 | D | D | D | E | D | D |
| Comparative example 2 | C | C | C | C | D | D |
| Comparative example 3 | D | D | D | E | B | B |

As is apparent from Table 2, the liquid developers of the invention were excellent in charging characteristic (positive charging characteristic) and dispersion stability of toner particles. Further, the liquid developers of the invention were also excellent in development efficiency and transfer efficiency. On the other hand, from the liquid developers of the respective Comparative examples, satisfactory results could not be obtained.

3. Production of Liquid Developer

A liquid developer was produced as follows.

Example 17

First, toner particles were produced. Steps in which a temperature is not specified were performed at room temperature (25° C.).

Dispersion Liquid Preparation Step

Preparation of Colorant Master Solution

First, a mixture of 48 parts by weight of a low-molecular weight polyester resin L1 (acid value: 8.5 mg KOH/g, weight average molecular weight Mw: 5,200, glass transition point Tg: 46° C., softening point T1/2: 95° C.) and 12 parts by weight of a high-molecular weight polyester resin H1 (acid value: 16.0 mg KOH/g, weight average molecular weight Mw: 237,000, glass transition point Tg: 63° C., softening point T1/2: 182° C.) was prepared as a polyester resin.

Subsequently, a mixture of the above polyester resin mixture and a cyan pigment (Pigment Blue 15:3, manufactured by Dainichiseika Color & Chemicals Mfg. Co., Ltd.) as a colorant at a mass ratio of 50:50 was prepared. The components were mixed using a 20-L Henschel mixer, whereby a raw material for producing a toner was obtained.

Then, the raw material (mixture) was kneaded using a twin-screw kneading extruder. The kneaded product extruded from the extrusion port of the twin-screw kneading extruder was cooled.

The thus cooled kneaded product was coarsely pulverized to prepare a colorant master batch having an average particle diameter of 1.0 mm or less. A hammer mill was used for coarse pulverization of the kneaded product.

Resin Liquid Preparation Treatment 175 parts by weight of methyl ethyl ketone, 172.3 parts by weight of the polyester resin mixture, and 55.3 parts by weight of a rosin-modified phenol resin (trade name "KG2212", manufactured by Arakawa Chemical Industries, Ltd., acid value: 22 mg KOH/g or less, softening point: 172 to 182° C., weight average molecular weight: 100000) were mixed in 97.5 parts by weight of the colorant master batch using a high-speed disperser (T.K. Robomix/T.K. Homo Disper Model 2.5, manufactured by Primix Corporation). Then, 1.38 parts by weight of NEOGEN SC-F (manufactured by Dai-ichi Kogyo Seiyaku Co., Ltd.) as an emulsifying agent was added to the mixture to prepare a resin liquid. In this resin liquid, the pigment was uniformly and finely dispersed.

Dispersoid Formation Treatment

Subsequently, 72.8 parts by weight of 1 N ammonia water was added to the resin liquid in a vessel and the mixture was sufficiently stirred using a high-speed disperser (T.K. Robomix/T.K. Homo Disper Model 2.5, manufactured by Primix Corporation) by setting a peripheral velocity of the stirring blade to 7.5 m/s and then, a liquid temperature in the flask was adjusted to 25° C. Thereafter, while stirring the mixture by setting a peripheral velocity of the stirring blade to 14.7 m/s, 400 parts by weight of deionized water was added dropwise thereto to cause phase inversion emulsification. While continuing stirring, 100 parts by weight of deionized water was further added to the resin liquid, whereby an aqueous dispersion liquid in which dispersoids containing the resin material were dispersed was obtained.

Coalescence Step

Subsequently, the aqueous dispersion liquid was transferred to a stirring vessel having a max blend blade, and a temperature of the aqueous dispersion liquid was adjusted to 25° C. while stirring the dispersion liquid by setting a peripheral velocity of the stirring blade to 1.0 m/s.

Subsequently, coalescent particles were formed by adding 200 parts by weight of a 5.0% aqueous solution of sodium sulfate dropwise to the dispersion liquid while maintaining the same temperature and stirring conditions to coalesce the dispersoids. After the dropwise addition, the mixture was kept stirring until toner particles of the coalescent particles were grown to have a 50% volume particle diameter Dv(50) (μm) of 3.5 μm. When the Dv(50) of the coalescent particles reached 3.5 μm, 200 parts by weight of deionized water was added and coalescence was finished.

Solvent Removal Step

The organic solvent was distilled off from the thus obtained coalescent particle dispersion liquid under reduced pressure until the solid content became 23 wt %, whereby a resin fine particle slurry was obtained.

Washing Step

Subsequently, the thus obtained slurry was subjected to solid-liquid separation, and further a procedure of redispersion in water (reslurry) and solid-liquid separation was performed repeatedly to effect a washing treatment. Then, the washed slurry was subjected to suction filtration, whereby a wet cake of colored resin fine particles (resin fine particle cake) was obtained. A content of water in the wet cake was 35 wt %.

Drying Step

Thereafter, the thus obtained wet cake was dried using a vacuum dryer, whereby toner particles were obtained.

Dispersion Step 37.5 parts by weight of the toner particles obtained by the above-mentioned method, 0.24 parts by weight of an alkyl diamine (trade name "Duomin CD", manufactured by Lion Akzo Co., Ltd., amine value: 437 mg KOH/g) and 0.48 parts by weight of an amide compound having a 12-hydroxystearic acid skeleton (trade name "Solsperse 11200", manufactured by The Lubrizol Corporation) as dispersants, 90 parts by weight of rapeseed oil (trade name "high-oleic rapeseed oil" manufactured by The Nisshin Oillio Group, Ltd.), and 60 parts by weight of soybean oil fatty acid methyl ester (manufactured by The Nisshin Oillio Group, Ltd.) were placed in a ceramic pot (internal capacity: 600 mL), and further zirconia balls (ball diameter: 1 mm) were placed in the ceramic pot such that a volume filling ratio became 85%. Then, the mixture in the pot was dispersed using a desktop pot mill at a rotational speed of 230 rpm for 24 hours, and thus a liquid developer was obtained.

The toner particles in the thus obtained liquid developer has a Dv(50) of 3.1 μm. The 50% volume particle diameter Dv(50) (μm) of the toner particles was measured using a particle analysis apparatus Mastersizer 1000 (manufactured by Malvern Instruments, Ltd.). Also, the particle diameters of particles obtained in the respective Examples mentioned below were determined in the same manner.

Further, a viscosity of the thus obtained liquid developer at 25° C. was 65 mPa·s.

Further, a magenta liquid developer, a yellow liquid developer, and a black liquid developer were produced in the same manner as described above except that a magenta pigment (Pigment Red 238, manufactured by Sanyo Color Works, Ltd.), ayellowpigment (Pigment yellow 180, manufactured by Clariant), a black pigment (carbon black Printex L, manufactured by Degussa) were used, respectively, instead of the cyan pigment.

Example 18

Liquid developers corresponding to the respective colors were produced in the same manner as in Example 17 except that a low-molecular weight polyester resin L2 and a high-molecular weight polyester resin H2 shown in Table 3 were used instead of the polyester resin L1 and the polyester resin H1, respectively.

Example 19

Liquid developers corresponding to the respective colors were produced in the same manner as in Example 17 except that a low-molecular weight polyester resin L3 and a high-molecular weight polyester resin H3 shown in Table 3 were used instead of the polyester resin L1 and the polyester resin H1, respectively.

A ratio of terephthalic acid (TPA) to isophthalic acid (IPA), a ratio of ethylene glycol (EG) to neopentyl glycol (NPG) in all monomer components used in the synthesis of each of the polyester resins used in Examples 17 to 19 described above, and physical properties of each resin and the like are shown in Table 3. Further, the weight average molecular weight Mw, glass transition point Tg, and softening point T1/2 of each of the low-molecular weight polyester resins and high-molecular weight polyester resins used in the respective Examples 17 to 19 are shown in Table 3.

Further, the measurement of glass transition point Tg of each polyester resin in Table 3 was performed as follows using DSC (DSC-220C, manufactured by Seiko Instruments, Inc.) as a measurement device. About 10 mg of a resin material was placed on an aluminum pan and the measurement was performed under conditions of a temperature increasing rate of 10° C./min and a measurement temperature range of from 30 to 150° C. Incidentally, the measurement was performed twice by increasing the temperature from 10° C. to 150° C. and decreasing it from 150° C. to 10° C. The data obtained at the second measurement was employed.

Further, the softening point T1/2 of each polyester resin in Table 3 was measured using a koka-type flow tester (manufactured by Shimadzu Corporation) as a measurement device under conditions of a temperature increasing rate of 5° C./min and a die diameter of 1.0 mm.

Further, with regard to Examples 17 to 19, the compositions of the liquid developers and the like are shown in Table 4. In the table, the polyester resins L1, L2, and are denoted by L1, L2, and L3, respectively; the polyester resins H1, H2, and H3 are denoted by H1, H2, and H3, respectively; the rosin-modified phenol resin (trade name "KG2212") is denoted by RP1; the Solsperse is denoted by S; the soybean oil fatty acid methyl ester is denoted by MONO; and the rapeseed oil is denoted by VO.

TABLE 3

| | | Resin L1 | Resin L2 | Resin L3 | Resin H1 | Resin H2 | Resin H3 |
|---|---|---|---|---|---|---|---|
| Using ratio of constituent monomers (parts by weight) | TPA:IPA | 40:60 | 60:40 | 80:20 | 70:30 | 70:30 | 74.5:25.5 |
| | EG:NPG | 50:50 | 50:50 | Using only EG | 60:40 | 60:40 | Using only EG |
| | W(EG)/W(NPG) | 1.0 | 1.0 | — | 1.5 | 1.5 | — |
| Physical properties | Glass transition point Tg (° C.) | 46 | 37 | 56 | 63 | 63 | 65 |
| | Softening point T½ (° C.) | 95 | 90 | 110 | 182 | 175 | 175 |
| | Mw | 5,200 | 3,900 | 8,900 | 237,000 | 359,900 | 78,000 |
| | Acid value (mg KOH/g) | 8.5 | 6.8 | 6.9 | 16.0 | 11.0 | 10.0 |

TABLE 4

| | Liquid developer | | | | | | | |
|---|---|---|---|---|---|---|---|---|
| | Toner particles | | | | | | | |
| | Resin material | | | | | | | |
| | Polyester resin | | | | | | | |
| | Low-molecular weight | | High-molecular weight | | | Rosin resin | | |
| | Type | Content in total polyester resin (wt %) | Type | Content in total polyester resin (wt %) | Content in resin material (wt %) | Type | Content in resin material (wt %) | Average particle diameter (μm) |
| Example 17 | L1 | 80 | H1 | 20 | 80 | RP1 | 20 | 3.1 |
| Example 18 | L2 | 80 | H2 | 20 | 80 | RP1 | 20 | 3.2 |
| Example 19 | L3 | 60 | H3 | 40 | 80 | RP1 | 20 | 3.2 |

| | Liquid developer | | | | | | | |
|---|---|---|---|---|---|---|---|---|
| | Dispersant | | | | | | | |
| | Alkyl diamine | | Amide compound having a 12-hydroxy-stearic acid skeleton | | | | | |
| | Amine value (mg KOH/g) | Content based on 100 parts by weight of toner particles (parts by weight) | Type | Content based on 100 parts by weight of toner particles (parts by weight) | Insulating liquid Type | Insulating liquid Content in insulating liquid (wt %) | Insulating liquid Type | Insulating liquid Content in insulating liquid (wt %) |
| Example 17 | 437 | 0.6 | S | 1.2 | VO | 60 | MONO | 40 |
| Example 18 | 437 | 0.6 | S | 1.2 | VO | 60 | MONO | 40 |
| Example 19 | 437 | 0.6 | S | 1.2 | VO | 60 | MONO | 40 |

Further, the respective liquid developers obtained in the above Examples 17 to 19 were evaluated in the same manner as in the above section 2 and these results are shown in Table 5.

TABLE 5

| | Development efficiency | Primary transfer efficiency | Secondary transfer efficiency | Positive charging characteristic | Dispersion stability 1 | Dispersion stability 2 |
|---|---|---|---|---|---|---|
| Example 17 | A | A | A | A | A | A |
| Example 18 | A | A | A | A | A | A |
| Example 19 | A | A | A | A | A | A |

As is apparent from Table 5, the liquid developers of the invention were excellent in charging characteristic (positive charging characteristic) and dispersion stability of toner particles. Further, the liquid developers of the invention were also excellent in development efficiency and transfer efficiency.

This application claims priority to Japanese Patent Application Nos. 2008-207422 file Aug. 11, 2008 and 2008-061550 file Mar. 11, 2008 which are hereby expressly incorporated by reference herein in their entirety.

What is claimed is:

1. A liquid developer comprising:

an insulating liquid;

toner particles constituted by a material containing a polyester resin; and an alkyl diamine and an amide compound having a hydroxy fatty acid skeleton as dispersants, wherein the alkyl diamine is a compound represented by the following general formula (I):

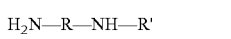

$$H_2N—R—NH—R' \quad (I)$$

wherein R represents an alkylene group having 2 to 6 carbon atoms, and R' represents an alkyl group having 8 to 24 carbon atoms.

2. The liquid developer according to claim 1, wherein a content of the alkyl diamine is from 0.1 to 8 parts by weight based on 100 parts by weight of the toner particles.

3. The liquid developer according to claim 1, wherein a content of the amide compound having a hydroxy fatty acid skeleton is from 0.1 to 7 parts by weight based on 100 parts by weight of the toner particles.

4. A liquid developer comprising:

an insulating liquid;

toner particles constituted by a material containing a polyester resin; and an alkyl diamine and an amide compound having a hydroxy fatty acid skeleton as dispersants, wherein the amide compound having a hydroxy fatty acid skeleton is a compound represented by the following general formula (II):

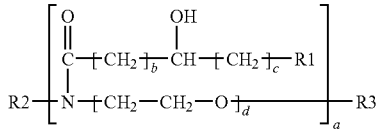

(II)

wherein R1, R2, and R3 each represent H, $CH_3$, OH, $OCH_3$, $OCH_2CH_3$, $CH_2$, $CH_2CH_3$, or a fatty acid having 12 to 18 carbon atoms, a=1 to 5, b=1 to 21, c=1 to 21, d=1 to 5, and (b+c)≦26.

5. The liquid developer according to claim 1, wherein the hydroxy fatty acid skeleton is a 12-hydroxystearic acid skeleton.

6. The liquid developer according to claim 1, wherein the material constituting the toner particles contains a rosin-modified resin other than the polyester resin.

7. The liquid developer according to claim 1, wherein the insulating liquid contains a vegetable oil.

8. The liquid developer according to claim 7, wherein the insulating liquid further contains a fatty acid monoester.

* * * * *